US006966282B2

(12) United States Patent
Hirano

(10) Patent No.: US 6,966,282 B2
(45) Date of Patent: Nov. 22, 2005

(54) INTERNAL COMBUSTION ENGINE VARIABLE COMPRESSION RATIO SYSTEM

(75) Inventor: Makoto Hirano, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/901,064

(22) Filed: Jul. 29, 2004

(65) Prior Publication Data

US 2005/0056239 A1 Mar. 17, 2005

(30) Foreign Application Priority Data

Jul. 13, 2003 (JP) ..... 2003/284427

(51) Int. Cl.[7] ..... F02D 15/02; F02B 75/04; F02F 3/00

(52) U.S. Cl. ..... 123/48 B; 123/78 B

(58) Field of Search ..... 123/48 R–48 B, 123/78 R–78 BA

(56) References Cited

U.S. PATENT DOCUMENTS 4,079,707 A * 3/1978 Karaba et al. ..... 123/78 B
4,934,347 A * 6/1990 Suga et al. ..... 123/78 B
4,979,427 A * 12/1990 Pfeffer et al. ..... 92/60.5
5,178,103 A * 1/1993 Simko ..... 123/48 B
5,179,916 A 1/1993 Schonfeld
6,752,105 B2 * 6/2004 Gray, Jr. ..... 123/48 B

FOREIGN PATENT DOCUMENTS

| | | | |
|---|---|---|---|
| JP | 7-113330 | B2 | 12/1995 |
| JP | 11-117779 | A | 4/1999 |
| WO | WO 02/103178 | A1 | 12/2002 |
| WO | WO 2004/013480 | A1 | 2/2004 |

* cited by examiner

*Primary Examiner*—Marguerite McMahon
(74) *Attorney, Agent, or Firm*—Birch, Stewart, Kolasch & Birch, LLP

(57) ABSTRACT

An internal combustion engine variable compression ratio system. The system includes an inner piston connected to a connecting rod, an outer piston fitted around the outer periphery of the inner piston so that the outer piston can slide only in the axial direction, and a retaining ring fixedly provided on the outer piston so as to axially oppose a head portion with the inner piston interposed between the restricting means and the head portion. Also included are a first cam mechanism disposed between the inner piston and the head portion for controlling a first axial spacing therebetween, and a second cam mechanism disposed between the inner piston and the retaining ring for controlling a second axial spacing therebetween.

12 Claims, 17 Drawing Sheets

HIGH COMPRESSION RATIO

LOW COMPRESSION RATIO

LOW COMPRESSION RATIO

HIGH COMPRESSION RATIO

LOW COMPRESSION RATIO

DURING SWITCHING

HIGH COMPRESSION RATIO

LOW COMPRESSION RATIO

MEDIUM COMPRESSION RATIO

HIGH COMPRESSION RATIO

INTERNAL COMBUSTION ENGINE VARIABLE COMPRESSION RATIO SYSTEM

CROSS-REFERENCE TO RELATED APPLICATION

The present application claims priority under 35 U.S.C. §119 to Japanese Patent Application Nos. 2003-284427, filed on Jul. 31, 2003, the entire contents of which are hereby incorporated by reference.

BACKGROUND OF THE INVENTION

1. Field of the Invention

The present invention relates to an internal combustion engine variable compression ratio system, and in particular to an improvement thereof in which a piston includes an inner piston and a outer piston. The inner piston is connected to a connecting rod via a piston pin, and the outer piston being fitted slidably around the outer periphery of the inner piston and having a head portion facing a combustion chamber. An operating device disposed between the inner piston and the outer piston moves and holds the outer piston relative to the inner piston alternately at a low compression ratio position close to the piston pin and at a high compression ratio position close to the combustion chamber, thereby making the engine compression ratio variable.

2. Background Art

As a conventional internal combustion engine variable compression ratio system, there is a known system (1) in which an outer piston is screwed around the outer periphery of a inner piston, and the outer piston is rotated forward and backward so that it approaches and recedes from the inner piston to move to a low compression ratio position and a high compression ratio position (for example, Japanese Patent Application Laid-open No. 11-117779).

Another known system (2) includes an outer piston is fitted in an axially slidable manner around the outer periphery of a inner piston, an upper hydraulic chamber and a lower hydraulic chamber are formed between the inner piston and the outer piston, and supply of hydraulic pressure alternately to these hydraulic chambers moves the outer piston to a low compression ratio position and a high compression ratio position (for example, Japanese Patent Publication No. 7-113330).

However, in the above-mentioned system (1), since it is necessary to rotate the outer piston in order to move it to the low compression ratio position and the high compression ratio position, the shape of the top face of the outer piston cannot be set freely so as to match the shape of the roof of a combustion chamber and the positional arrangement of intake and exhaust valves, and it is difficult to sufficiently increase the compression ratio of the engine at the high compression ratio position. Furthermore, in the above-mentioned system (2), particularly when the outer piston is at the high compression ratio position, since a large thrust load acting on the outer piston during an expansion stroke of the engine is borne by the hydraulic pressure of the upper hydraulic chamber, it is necessary for the upper hydraulic chamber to have a seal that can withstand high pressure, and moreover if bubbles are generated in the upper hydraulic chamber, the high compression ratio position of the outer piston becomes unstable, so that it is necessary to provide means for removing such bubbles, thus inevitably increasing the overall cost.

SUMMARY AND OBJECTS OF THE INVENTION

The present invention has been accomplished under the above-mentioned circumstances, and it is an object thereof to provide an internal combustion engine variable compression ratio system that enables an outer piston to be moved to and held at a low compression ratio position and a high compression ratio position simply and reliably without rotating the outer piston.

In order to attain this object, in accordance with a first aspect of the present invention, there is provided an internal combustion engine variable compression ratio system that includes an inner piston connected to a connecting rod via a piston pin, an outer piston with a head portion facing a combustion chamber and fitted around the outer periphery of the inner piston so that the outer piston can slide only in the axial direction. Also included are restricting means fixedly provided on the outer piston so as to axially oppose the head portion with the inner piston interposed between the restricting means and the head portion, a first cam mechanism that is disposed between the inner piston and the head portion and that controls a first axial spacing therebetween, and a second cam mechanism that is disposed between the inner piston and the restricting means and that controls a second axial spacing therebetween.

In addition, the first cam mechanism has a first rotating cam plate that is rotatable between first and second rotational positions around the axis of the inner piston, and is arranged so that the first cam mechanism axially compresses at the first rotational position of the first rotating cam plate so as to allow the first axial spacing to decrease and axially expands at the second rotational position so as to allow this axial spacing to increase. Further, the second cam mechanism has a second rotating cam plate that is rotatable between third and fourth rotational positions around the axis of the inner piston, and is arranged so that the second cam mechanism axially expands at the third rotational position of the second rotating cam plate so as to allow the second axial spacing to increase and axially compresses at the fourth rotational position so as to allow this axial spacing to decrease; and wherein the first and second rotating cam plates are connected to driving means for moving the first rotating cam plate to the first rotational position and moving the second rotating cam plate to the third rotational position so as to hold the outer piston at a low compression ratio position, and for moving the first rotating cam plate to the second rotational position and moving the second rotating cam plate to the fourth rotational position so as to hold the outer piston at a high compression ratio position.

The driving means corresponds to first and second actuators and of an embodiment of the present invention, which will be described later, and the restricting means corresponds to a retaining ring.

Furthermore, in accordance with a second aspect of the present invention, there is provided an internal combustion engine variable compression ratio system wherein the driving means includes a first actuator with first hydraulic operating means for moving the first rotating cam plate toward one of the first and second rotational positions and a first return spring urging the first rotating cam plate toward the other of the first and second rotational positions. A second actuator includes second hydraulic operating means for moving the second rotating cam plate toward one of the third and fourth rotational positions and a second return spring urging the second rotating cam plate toward the other of the third and fourth rotational positions.

The first hydraulic operating means corresponds to an operating plunger and a hydraulic chamber of the embodiment of the present invention, which will be described later, the second hydraulic operating means corresponds to an operating plunger and a hydraulic chamber the first return spring corresponds to a return spring, and the second return spring corresponds to a return spring.

Moreover, in accordance with a third aspect of the present invention, there is provided an internal combustion engine variable compression ratio system wherein the first hydraulic operating means is arranged so as to move the first rotating cam plate to the second rotational position when operated hydraulically, and wherein the second hydraulic operating means is arranged so as to move the second rotating cam plate to the fourth rotational position when operated hydraulically.

Furthermore, in accordance with a fourth aspect of the present invention, there is provided an internal combustion engine variable compression ratio system wherein supply and release of hydraulic pressure for the first and second hydraulic operating means are carried out by a common control valve.

Moreover, in accordance with a fifth aspect of the present invention, there is provided an internal combustion engine variable compression ratio system wherein release of hydraulic pressure from the first and second hydraulic operating means is started during an intake stroke of the internal combustion engine, and supply of hydraulic pressure to the first and second hydraulic operating means is started during an exhaust stroke of the internal combustion engine.

Furthermore, in accordance with a sixth aspect of the present invention, there is provided an internal combustion engine variable compression ratio system wherein there are provided a plurality of the first cam mechanisms and a plurality of the second cam mechanisms, the numbers thereof being the same.

Moreover, in accordance with a seventh aspect of the present invention, there is provided an internal combustion engine variable compression ratio system wherein the first rotating cam plate is supported by one of the inner piston and the outer piston in an axially immovable but pivotable manner, and a first fixed cam forming the first cam mechanism in cooperation with the first rotating cam plate is fixedly provided on the other one of the inner piston and the outer piston, and wherein the second rotating cam plate is supported by one of the inner piston and the outer piston in an axially immovable but pivotable manner, and a second fixed cam forming the second cam mechanism in cooperation with the second rotating cam plate is fixedly provided on the other one of the inner piston and the outer piston.

In accordance with the first aspect of the present invention, moving the first rotating cam plate to the first rotational position and the second rotating cam plate to the third rotational position using the driving means enables the outer piston to be moved to and held at a low compression position, which is closer to the piston pin relative to the inner piston; and moving the first rotating cam plate to the second rotational position and the second rotating cam plate to the fourth rotational position enables the outer piston to be moved to and held at a high compression position, which is closer to the combustion chamber relative to the inner piston, by virtue of axial expansion of the first cam mechanism and axial compression of the second cam mechanism.

Whether the outer piston is at the low compression ratio position or the high compression ratio position, the inner piston and the outer piston are always connected securely in the axial direction via the first and second cam mechanisms, and since the thrust load acting between the inner piston and the outer piston is carried mechanically by the first and second cam mechanisms, not only is it possible to increase the piston strength effectively but it is also possible to reduce the capacity of the driving means and, consequently, the dimensions thereof.

In particular, since the first cam mechanism allows the outer piston to move between the low compression ratio position and the high compression ratio position when the first rotating cam plate is at the first rotational position, and the second cam mechanism similarly allows the outer piston to move between the low compression ratio position and the high compression ratio position when the second rotating cam plate is at the fourth rotational position, the outer piston can be moved to the low compression ratio position and the high compression ratio position by utilizing an external force such as a difference in inertial force between the inner piston and the outer piston, the sliding resistance between the outer piston and the cylinder bore inner face, or negative pressure and positive pressure on the combustion chamber side. Moreover, since the driving means for rotating the first and second cam plates receives a zero or extremely small thrust load from the inner piston and the outer piston, it is possible to reduce the capacity of the driving means and, consequently, the dimensions thereof.

Furthermore, since the outer piston does not rotate relative to the inner piston, the head portion of the outer piston, which faces the combustion chamber, can match the shape of the combustion chamber, thereby effectively increasing the compression ratio when the outer piston is at the high compression ratio position.

Moreover, in accordance with the second aspect of the present invention, with regard to the first and second actuators, the hydraulic operating means can be formed as a structurally simple single-acting system, so that the driving means can be obtained at low cost. Moreover, since the hydraulic operating means of the first and second actuators receive a zero or extremely small thrust load from the inner piston and the outer piston, it is possible to reduce the capacity and the dimensions of the hydraulic operating means, and even if some bubbles are generated in the hydraulic chamber, the outer piston can be held stably at the low compression ratio position and the high compression ratio position without being affected by the bubbles.

Furthermore, in accordance with the third aspect of the present invention, in the event of the hydraulic pressure system malfunctioning, the operation of the return springs of the first and second actuators enables the outer piston to be automatically moved to and held at the low compression position.

Moreover, in accordance with the fourth aspect of the present invention, the hydraulic pressure control system for the first and second hydraulic operating means can be simplified, thereby reducing the cost.

Furthermore, in accordance with the fifth aspect of the present invention, by effectively utilizing a difference in inertial force between the inner piston and the outer piston it is possible to quickly move the outer piston from the high compression ratio position to the low compression ratio position, or from the low compression ratio position to the high compression ratio position.

Moreover, in accordance with the sixth aspect of the present invention, by combining axially compressed and expanded states of the first cam mechanisms and axially compressed and expanded states of the second cam mechanisms it is possible to control the compression ratio position of the outer piston by switching between three or more stages, that is, low, medium, high, etc.

Furthermore, in accordance with the seventh aspect of the present invention, since the first rotating cam plate and the first fixed cam are axially supported by one and the other of the inner piston and the outer piston respectively, and the second rotating cam plate and the second fixed cam are axially supported by one and the other of the inner piston and the outer piston respectively, is there no axial play in the fixed cams as well as in the pivoting cam plates while the inner piston and the outer piston are moving axially relative to each other. Therefore, when the first cam mechanism and the second cam mechanism alternately expand and compress by utilizing an external force such as a difference in inertial force between the inner piston and the outer piston, it is possible to reliably avoid mutual interference between each fixed cam and its corresponding rotating cam plate, thus reliably rotating the respective rotating cam plates to desired rotational positions by the driving force of the driving means, and thereby reliably holding the outer piston at desired low compression ratio position and high compression ratio position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

The first embodiment of the present invention is first explained with reference to FIG. 1 to FIG. 15D.

Figure 1:
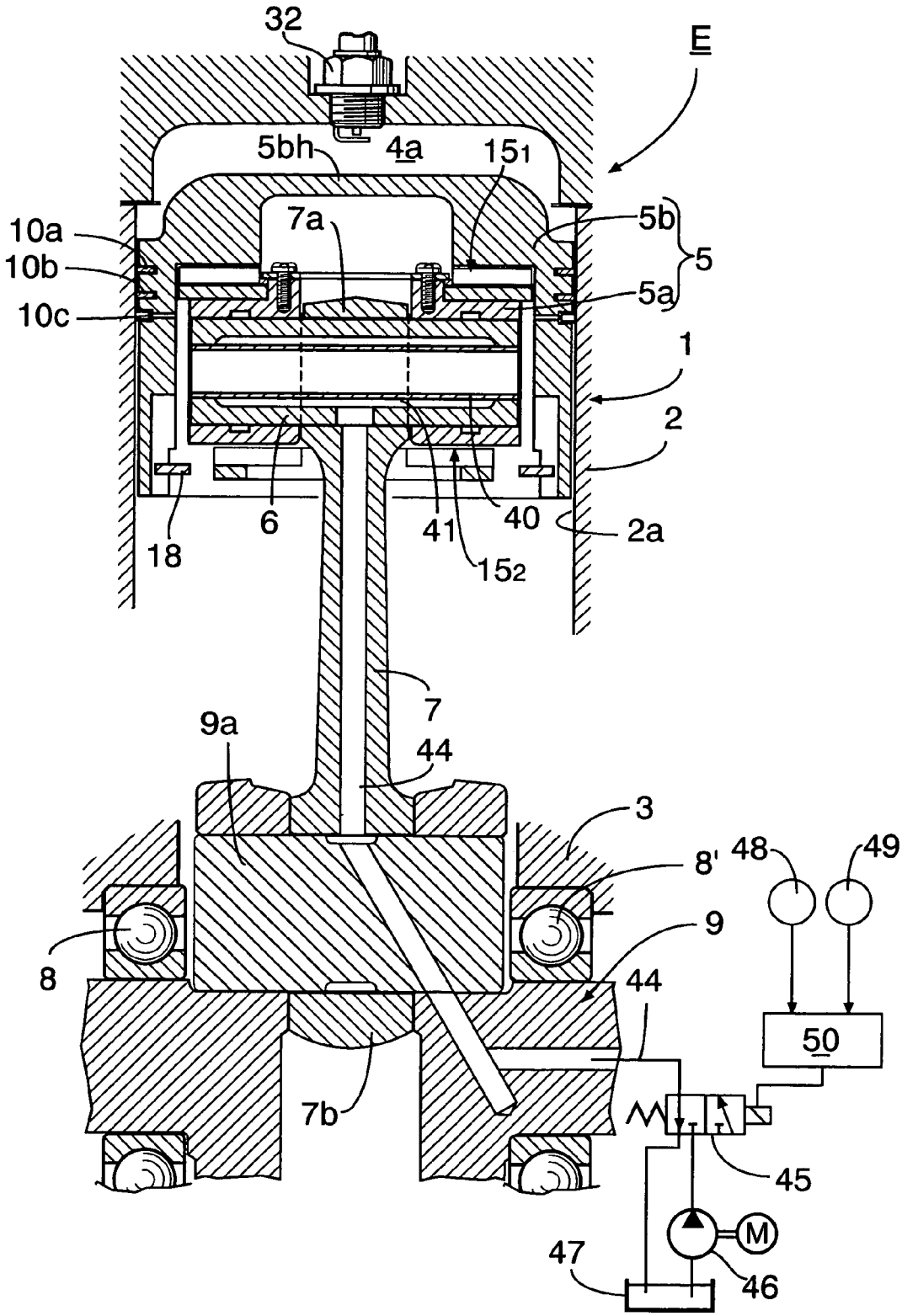
FIG. 1 is a vertical sectional front view of an essential part of an internal combustion engine provided with a variable compression ratio system related to a first embodiment of the present invention.

In FIG. 1, an engine main body 1 of an internal combustion engine E includes a cylinder block 2 having a cylinder bore 2*a,* a crankcase 3 joined to the lower end of the cylinder block 2, and a cylinder head 4 that has a pentroof-shaped combustion chamber 4*a* extending from the upper end of the cylinder bore 2*a* and is joined to the upper end of the cylinder block 2. The cylinder head 4 is provided with an intake valve 31*i* and an exhaust valve 31*e* for opening and closing an intake port 30*i* and an exhaust port 30*e* respectively, the intake port 30*i* and the exhaust port 30*e* opening in the roof of the combustion chamber 4*a,* and a spark plug 32 is screwed into the cylinder head 4, the electrodes of the spark plug 32 facing a central part of the combustion chamber 4*a*.

A piston 5 is fitted slidably in the cylinder bore 2*a,* a small end 7*a* of a connecting rod 7 is connected to the piston 5 via a piston pin 6, and a large end 7*b* of the connecting rod 7 is connected via a pair of left and right bearings 8 and 8' to a crankpin 9*a* of a crankshaft 9 rotatably supported in the crankcase 3.

Figure 2:
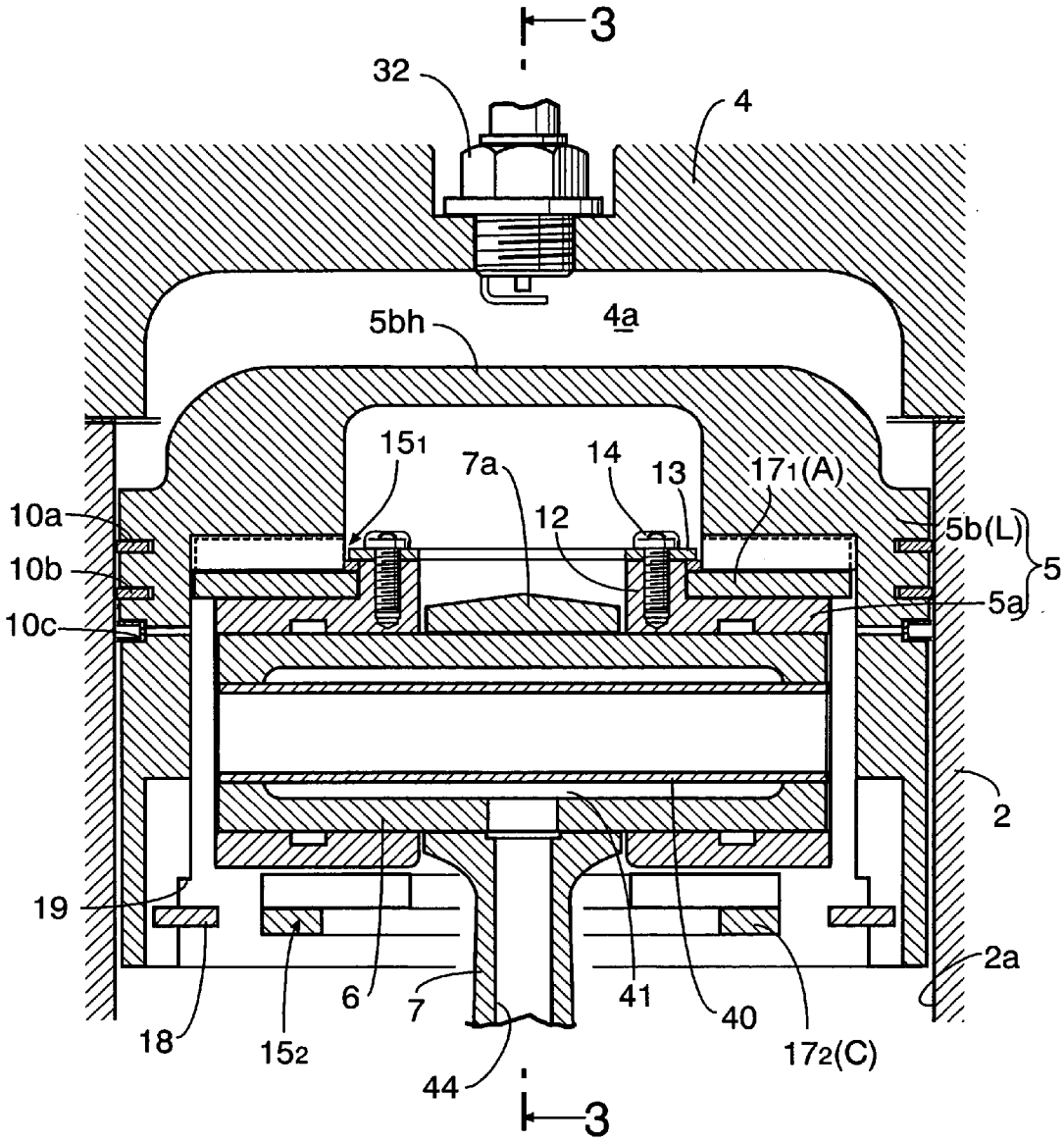
FIG. 2 is an enlarged view of an essential part of FIG. 1.
Figure 3:
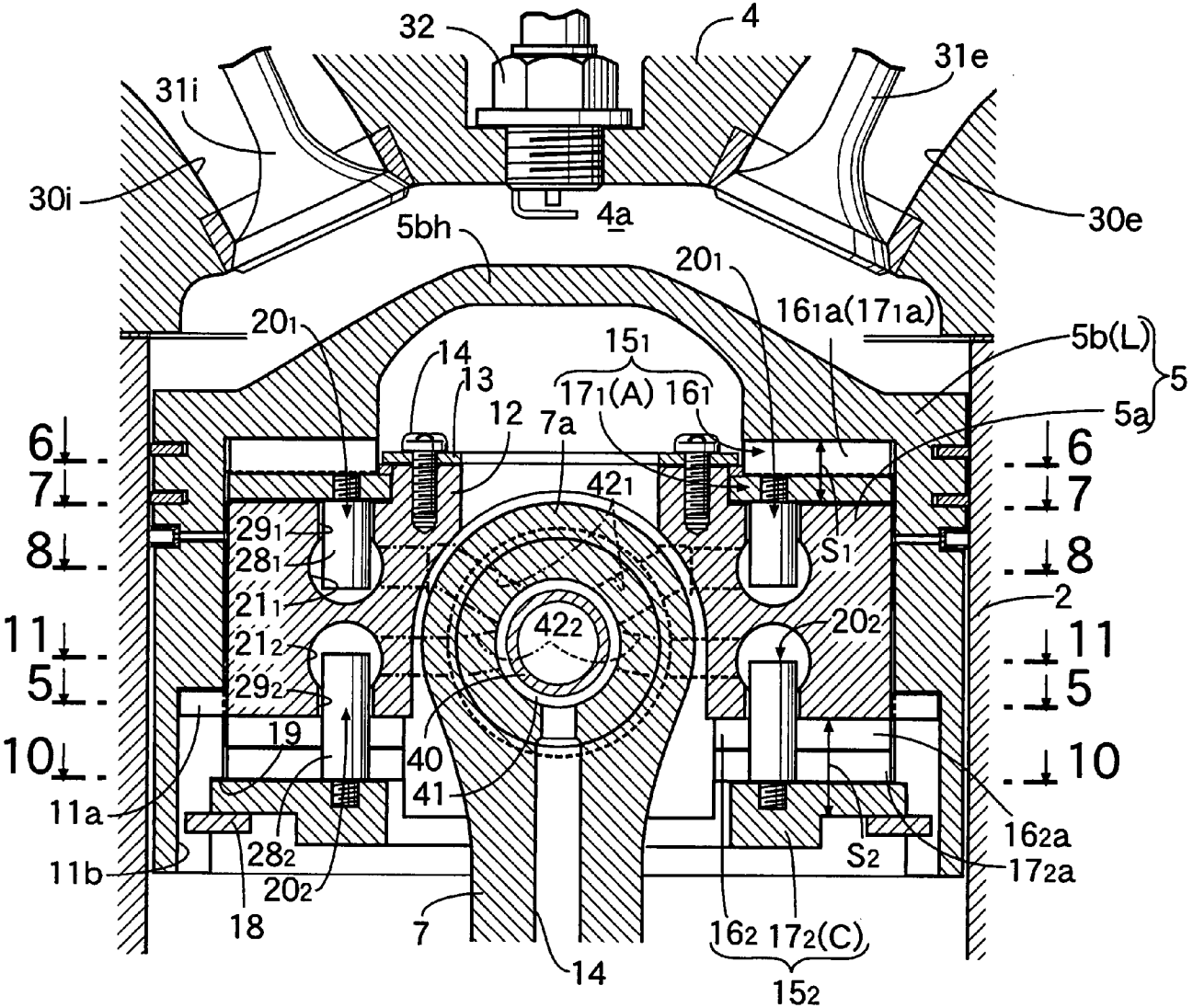
FIG. 3 is an enlarged sectional view, along line 3—3 in FIG. 2, showing a low compression ratio state.
Figure 4:
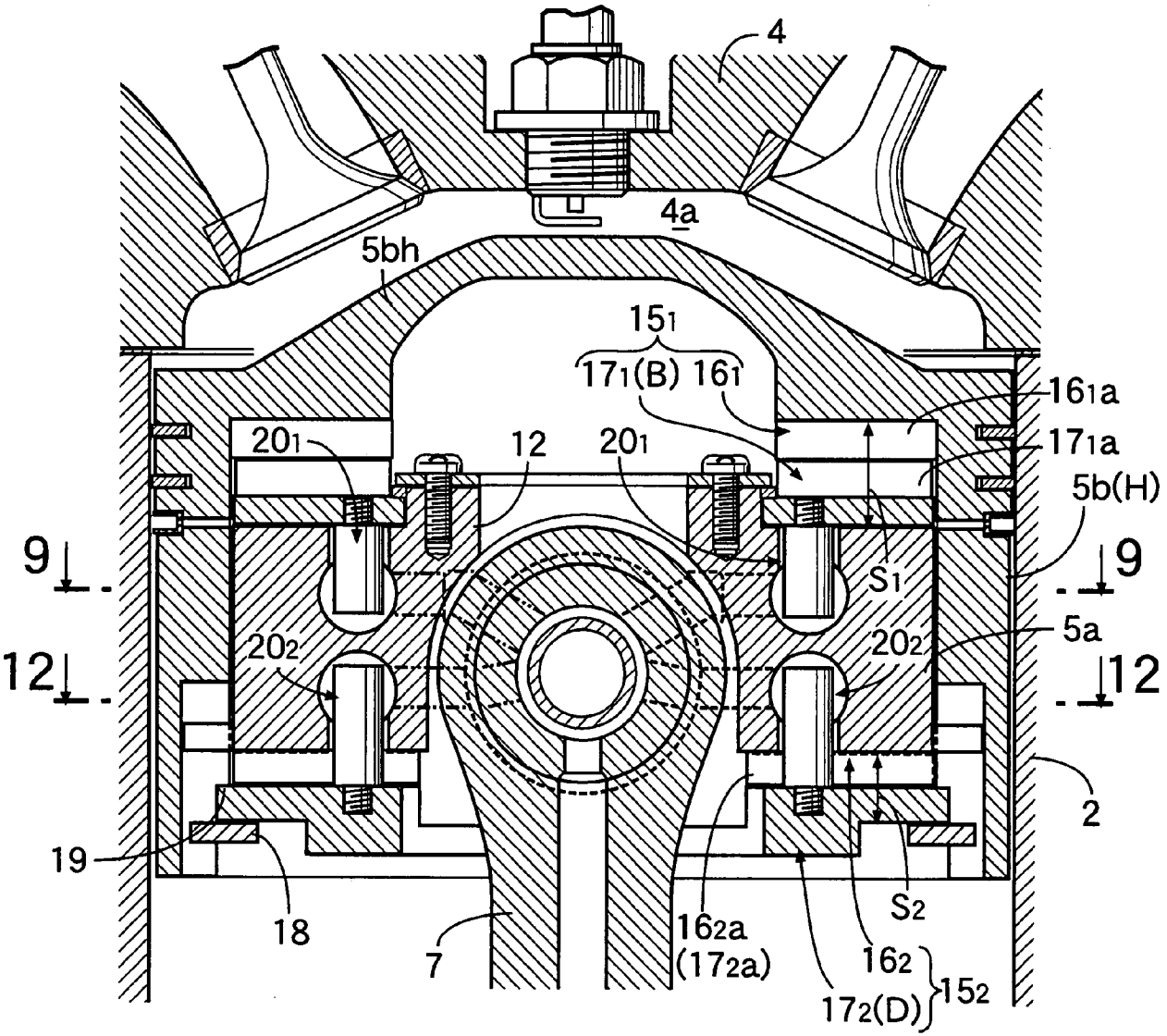
FIG. 4 is a view, corresponding to FIG. 3, showing a high compression ratio state.

In FIG. 2 to FIG. 4, the piston 5 includes a inner piston 5*a* and a outer piston 5*b,* the inner piston 5*a* being connected to the small end 7*a* of the connecting rod 7 via the piston pin 6, the outer piston 5*b* being slidably fitted around an outer peripheral face of the inner piston 5*a* and being capable of moving on the inner piston 5*a* between a predetermined low compression ratio position L (see FIG. 3) and a predetermined high compression ratio position H (see FIG. 4). The outer piston 5*b* is slidably fitted to an inner peripheral face of the cylinder bore 2*a* via a plurality of piston rings 10*a* to 10*c* mounted on the outer periphery of the outer piston 5*b,* and a head portion 5*bh* of the outer piston 5*b* faces the combustion chamber 4*a*. The head portion 5*bh* has a peaked shape so as to match the shape of the pent-roof combustion chamber 4*a*.

Figure 5:
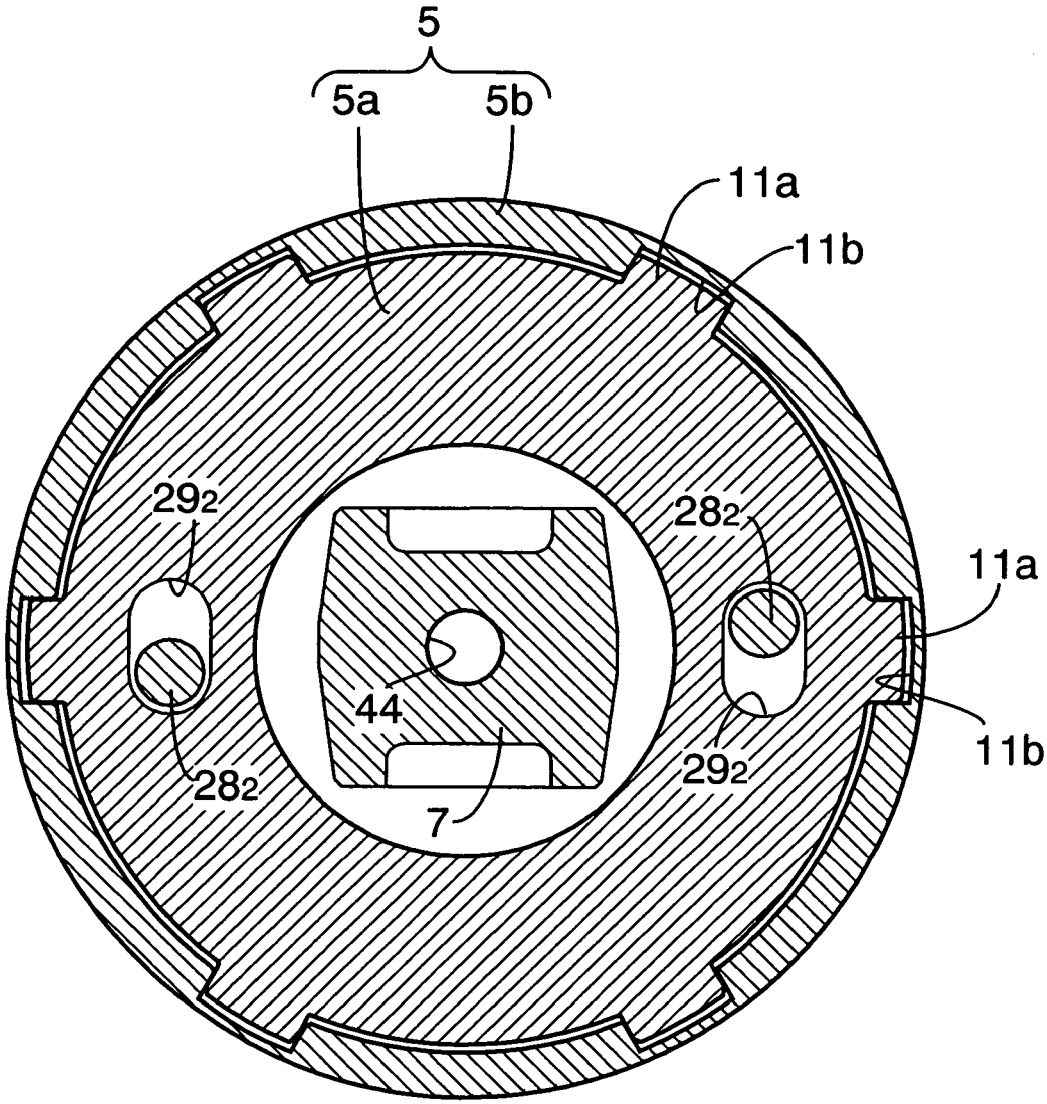
FIG. 5 is an enlarged sectional view along line 5—5 in FIG. 3.

As shown in FIG. 3 and FIG. 5, a plurality of spline teeth 11*a* and spline grooves 11*b* extending in the axial direction of the piston 5 and engaging with each other are formed on the sliding mating faces of the inner piston and outer 5*a* and 5*b* respectively, thereby preventing relative rotation of the inner piston and outer 5*a* and 5*b* around their axes. Furthermore, a retaining ring 18 for restricting axial movement of the inner piston 5*a* relative to the outer piston 5*b* is latched to an inner peripheral face of the outer piston 5*b* so that the inner piston 5*a* is interposed between the retaining ring 18 and, on the opposite side, the head portion 5*bh*.

A first cam mechanism $\mathbf{15}_1$ is disposed between the inner piston 5*a* and the head portion 5*bh* so as to control a first axial spacing $S_1$ therebetween, and a second cam mechanism $15_2$ is disposed between the inner piston 5*a* and the retaining ring 18 so as to control a second axial spacing $S_2$ therebetween. Increasing and decreasing the first and second axial spacings $S_1$ and $S_2$ oppositely to each other by means of these first and second cam mechanisms $15_1$ and $15_2$ enables the outer piston 5*b* to be held alternately at the low compression ratio position L, which is close to the piston pin relative to the inner piston 5*a,* and at the high compression ratio position H, which is close to the combustion chamber 4*a* relative to the inner piston 5*a*.

Figure 6:
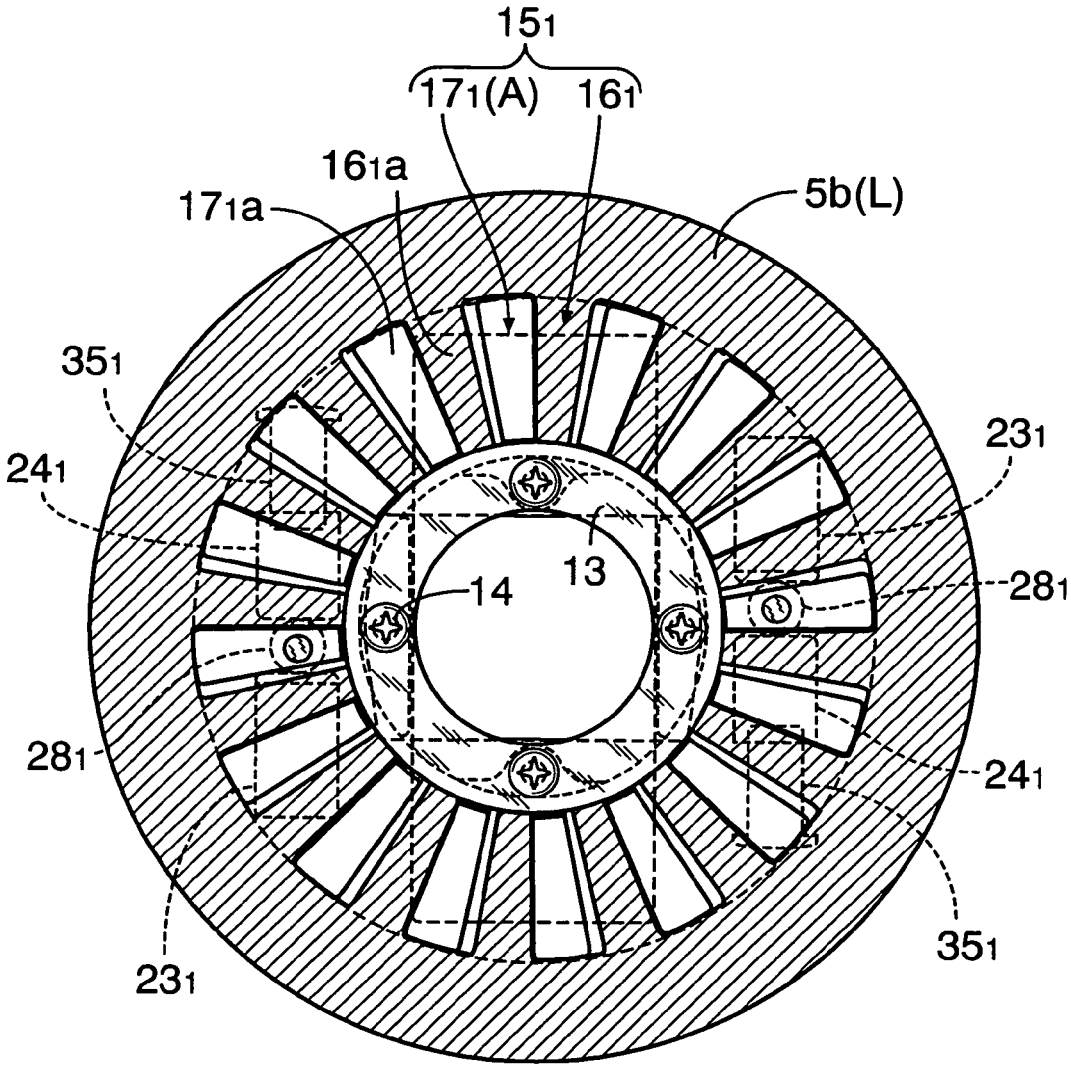
FIG. 6 is an enlarged sectional view along line 6—6 in FIG. 3.
Figure 7:
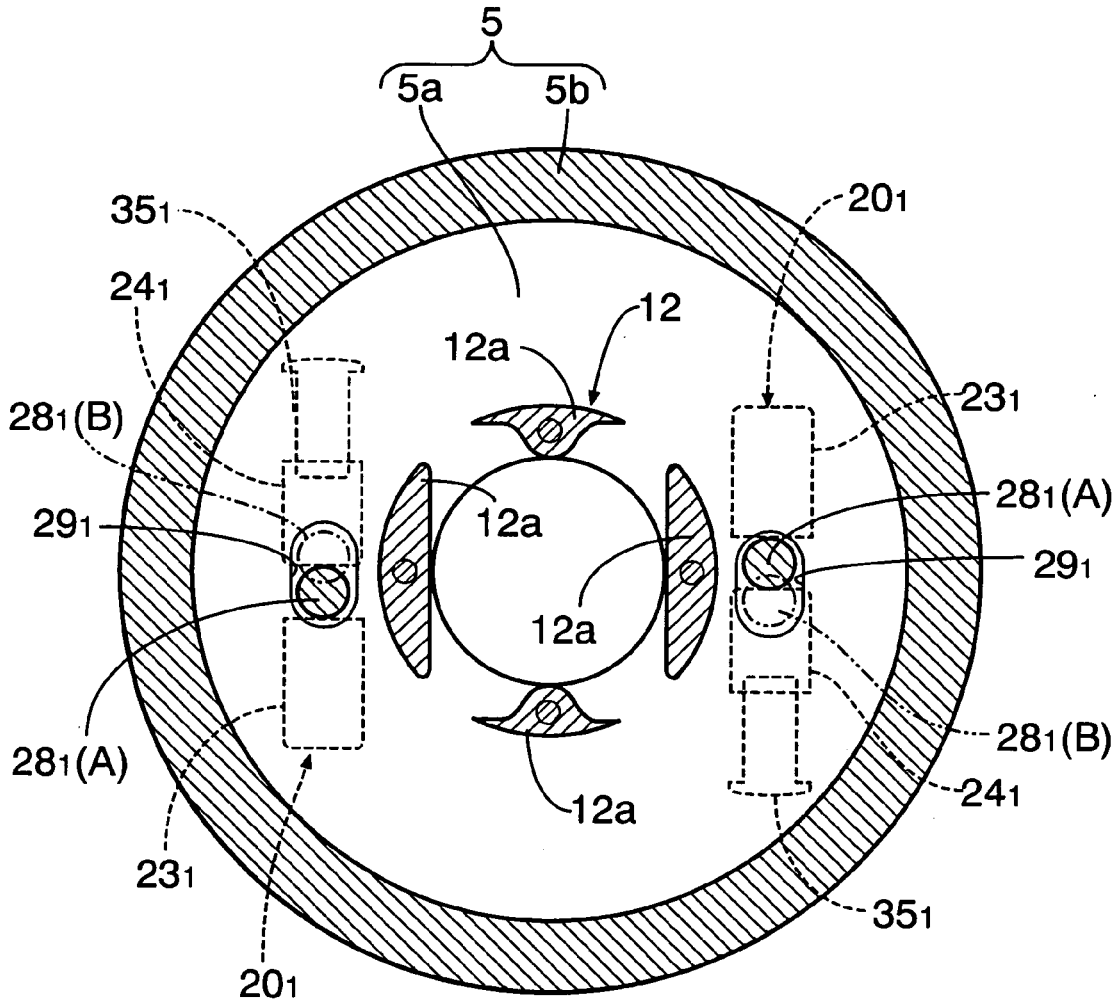
FIG. 7 is an enlarged sectional view along line 7—7 in FIG. 3.
Figure 8:
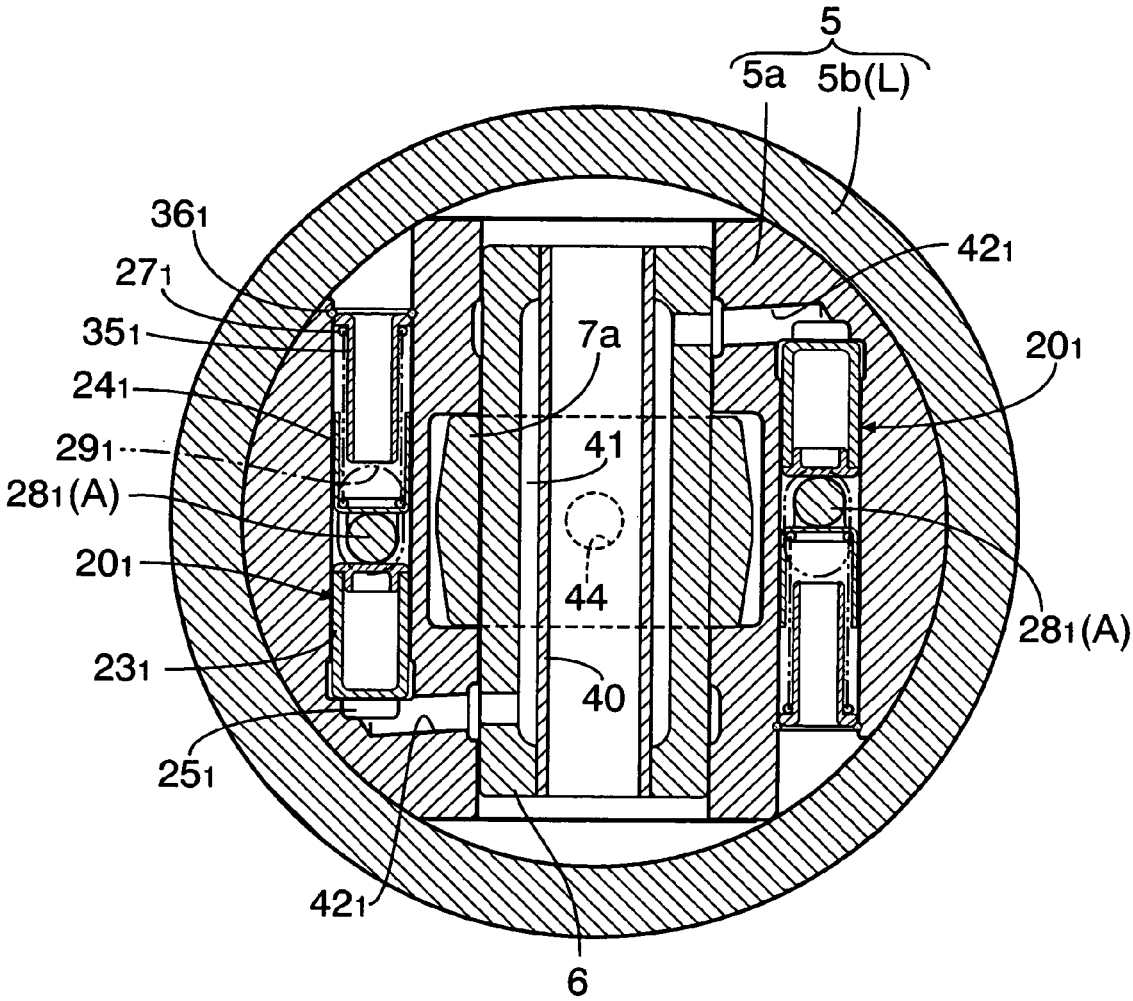
FIG. 8 is an enlarged sectional view along line 8—8 in FIG. 3.
Figure 13:
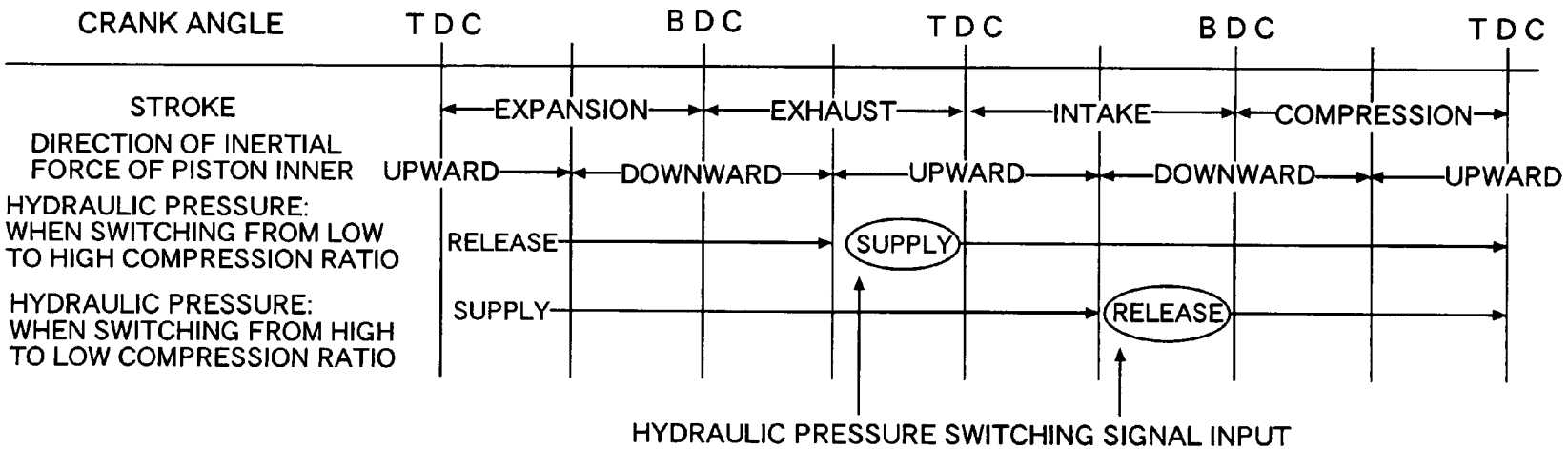
FIG. 13 is a chart showing the relationship between the compression ratio switching timing and the inertial force of a inner piston.

In FIG. 3, FIG. 6, and FIG. 13, the first cam mechanism $15_1$, includes an upper first fixed cam $16_1$, and a lower first rotating cam plate $17_1$, the first fixed cam $16_1$, being formed on an inner wall of the head portion 5*bh* of the outer piston 5*b,* and the first rotating cam plate $17_1$, being supported on an upper face of the inner piston 5*a* while being pivotably fitted around a pivot portion 12 integrally and projectingly provided on the upper face of the inner piston 5*a*. The pivot portion 12 is divided into a plurality of blocks 12*a* (see FIG. 7) so as to receive the small end 7*a* of the connecting rod 7. Fixed to end faces of these blocks 12*a* via a plurality of bolts 14 is a retaining plate 13 for blocking axial movement of the first rotating cam plate $17_1$, on the pivot portion 12.

The first rotating cam plate $17_1$, is capable of rotating between first and second rotational positions A and B set around the axis thereof, and its reciprocating rotation, in cooperation with the first fixed cam $16_1$, increases and decreases the first axial spacing $S_1$. Specifically, the first fixed cam $16_1$ includes a plurality of cam peaks $16_1a$ arranged in the peripheral direction, and similarly the first rotating cam plate $17_1$ is provided integrally with a plurality of cam peaks $17_1$ arranged in the peripheral direction. Each of the cam peaks $16_1a$ and $17_1a$ of the first fixed cam $16_1$ and the first rotating cam plate $17_1$ has a rectangular shape, as shown in FIGS. 14A to 14D, in which opposite side faces arranged in the peripheral direction are vertical faces and a top face connecting upper edges of opposite vertical faces is flat.

When the first rotating cam plate $17_1$ is at the first rotational position A, the cam peak $16_1a$ of the upper first fixed cam $16_1$ can go in and out of a valley between adjacent cam peaks $17_1a$ of the first rotating cam plate $17_1$ (see FIGS. 14A and 14B), and as a result movement of the outer piston 5*b* to the low compression ratio position L or the high compression ratio position H is allowed. When the upper and lower cam peaks $16_1a$ and $17_1a$ mesh with each other, the first cam mechanism $15_1$ is in an axially compressed state, thus decreasing the first axial spacing $S_1$.

On the other hand, when the first rotating cam plate $17_1$ is at the second rotational position B, the flat tops of the cam peaks $16_1a$ and $17_1a$ of the first fixed cam $16_1$ and the first rotating cam plate $17_1$ abut against each other (see FIG. 14A), and the first cam mechanism $15_1$ is thus in an axially expanded state, thereby increasing the first axial spacing $S_1$ and holding the outer piston 5*b* at the high compression ratio position H.

Provided between the inner piston 5*a* and the first rotating cam plate $17_1$ is a first actuator $20_1$ for rotating the first rotating cam plate $17_1$ alternately to the first rotational position A and the second rotational position B. This first actuator $20_1$ is explained with reference to FIG. 3, FIG. 4, FIG. 8, and FIG. 9.

The inner piston 5*a* is provided with a pair of bottomed cylinder holes $21_1$ extending parallel to the piston pin 6 on either side thereof, and long holes $29_1$ running through an upper wall of a middle section of each of the cylinder holes $21_1$. A pair of pressure-receiving pins $28_1$ projectingly provided integrally with a lower face of the first rotating cam plate $17_1$ and arranged on a diameter thereof run through the long holes $29_1$, face the cylinder holes $21_1$. The long holes $29_1$ are arranged so that the pressure-receiving pins $28_1$ are not prevented from moving together with the first rotating cam plate $17_1$ between the first rotational position A and the second rotational position B.

An operating plunger $23_1$ and a bottomed cylindrical return plunger $24_1$ are fitted slidably in each of the cylinder holes $21_1$ with the corresponding pressure-receiving pin $28_1$ interposed therebetween. In this arrangement, the operating plungers $23_1$ and the return plungers $24_1$ are each disposed point-symmetrically relative to the axis of the piston 5.

A first hydraulic chamber $25_1$ is defined within each of the cylinder holes $21_1$, the inner end of the operating plunger $23_1$ facing the first hydraulic chamber $25_1$. When hydraulic pressure is supplied to the chamber $25_1$ the operating plunger $23_1$ receives the hydraulic pressure and rotates the first rotating cam plate $17_1$ to the second rotational position B via the pressure-receiving pin $28_1$.

Moreover, a cylindrical spring retaining tube $35_1$ is latched at an end portion on the open side of each of the cylinder holes $21_1$ via a retaining ring $36_1$, and a return spring $27_1$ is provided under compression between the spring retaining tube $35_1$ and the return plunger $24_1$, the return spring $27_1$ urging the return plunger $24_1$ toward the pressure-receiving pin $28_1$.

In this way, the first rotational position A of the first rotating cam plate. $17_1$ is defined by each of the pressure-receiving pins $28_1$ abutting against the extremity of the operating plunger $23_1$, which abuts against the bottom face of the cylinder hole $21_1$ (see FIG. 8), and the second rotational position B of the first rotating cam plate $17_1$ is defined by the return plunger $24_1$, which is pushed by the pressure-receiving pin $28_1$, abutting against the extremity of the spring retaining tube $35_1$ (see FIG. 9).

In FIG. 3, FIG. 10, and FIGS. 14A to 14D, the second cam mechanism $15_2$ includes an upper second fixed cam $16_2$ and a lower second rotating cam plate $17_2$, the second fixed cam $16_2$ being formed on a lower end wall of the inner piston 5*a,* and the second rotating cam plate $17_2$ being rotatably fitted to an inner peripheral face of the outer piston 5*b* above the retaining ring 18. An annular shoulder 19 is formed on the inner periphery of the outer piston 5*b,* the shoulder 19 abutting against an upper face of the second rotating cam plate $17_2$, and this shoulder 19 and the retaining ring 18 hold the second rotating cam plate $17_2$ so that it can rotate but is prevented from axially moving relative to the outer piston 5*b*.

The second rotating cam plate $17_2$ is capable of rotating between a third rotational position C and a fourth rotational position D set around the axis thereof, and its reciprocating rotation, in cooperation with the second fixed cam $16_2$, increases and decreases the second axial spacing $S_2$. Specifically, the second fixed cam $16_2$ includes a plurality of cam peaks $16_2a$ arranged in the peripheral direction, and similarly the second rotating cam plate $17_2$ is integrally provided with a plurality of cam peaks $17_2a$ arranged in the peripheral direction. Each of the cam peaks $16_1a$ and $17_1a$ of the first fixed cam $16_1$ and the first rotating cam plate $17_1$ has a rectangular shape in which opposite side faces arranged in the peripheral direction are vertical faces and a top face connecting upper edges of opposite vertical faces is flat. The rotational angle between the third and fourth rotational positions C and D of the second rotating cam plate $17_2$ is set so as to be identical to the rotational angle between the first and second rotational positions A and B of the first rotating cam plate $17_1$. Furthermore, at least the effective heights of the cam peaks $16_2a$ and $17_2a$ of the second fixed cam $16_2$ and the second rotating cam plate $17_2$ are set so as to be identical to those of the cam peaks $16_1a$ and $17_2a$ of the first fixed cam $16_1$ and the first rotating cam plate $17_1$. In the illustrated case, the cam peaks $16_2a$ and $17_2a$ are formed so as to have the same shape as that of the cam peaks $16_1a$ and $17_2a$. The second fixed cam $16_2$ and the second rotating cam plate $17_2$ are provided with sections where no cam peak is present in order to avoid interference with a pin boss portion that supports the piston pin 6 of the inner piston 5*a* (see FIG. 10).

When the second rotating cam plate $17_2$ is at the third rotational position C, the flat top faces of the cam peaks $16_2a$ and $17_2a$ of the second fixed cam $16_2$ and the second rotating cam plate $17_2$ abut against each other (see FIG. 14D), so that the second cam mechanism $15_2$ is in an axially expanded state, thus increasing the second axial spacing $S_2$ and holding the outer piston 5*b* at the low compression ratio position L.

When the second rotating cam plate $17_2$ is at the fourth rotational position D, the cam peak $16_2a$ of the second fixed cam $16_2$ can go in and out of a valley between adjacent cam peaks $17_2a$ of the second rotating cam plate $17_2$ (see FIGS. 14A and 14C), and as a result movement of the outer piston 5*b* to the low compression ratio position L or the high compression ratio position H is allowed. When the upper and lower cam peaks $16_2a$ and $17_2a$ mesh with each other, the second cam mechanism $15_2$ is in an axially compressed state, thus decreasing the second axial spacing $S_2$.

Provided between the inner piston 5*a* and the second rotating cam plate $17_2$ is a second actuator $20_2$ for rotating the second rotating cam plate $17_2$ alternately to the third rotational position C and the fourth rotational position D. This second actuator $20_2$ is explained with reference to FIG. 3, FIG. 4, FIG. 11, and FIG. 12.

The structures of the second actuator $20_2$ and the first actuator $20_1$ are symmetrical. That is, the inner piston 5*a* is provided with a pair of bottomed cylinder holes $21_2$ extending parallel to the piston pin 6 on either side thereof, and long holes $29_2$ running through an upper wall of a middle section of the cylinder holes $21_2$. A pair of pressure-receiving pins $28_2$ projectingly provided integrally with a lower face of the second rotating cam plate $17_2$ and arranged on a diameter thereof run through the long holes $29_2$ face the cylinder holes $21_2$. The long holes $29_2$ are arranged so that the pressure-receiving pins $28_2$ are not prevented from moving together with the second rotating cam plate $17_2$ between the third rotational position C and the fourth rotational position D.

An operating plunger $23_2$ and a bottomed cylindrical return plunger $24_2$ are fitted slidably in each of the cylinder holes $21_2$ with the corresponding pressure-receiving pin $28_2$ interposed therebetween. In this arrangement, the operating plungers $23_2$ and the return plungers $24_2$ are each disposed point-symmetrically relative to the axis of the piston 5.

A second hydraulic chamber $25_2$ is defined within each of the cylinder holes $21_2$, the inner end of the operating plunger $23_2$ facing the second hydraulic chamber $25_2$. When hydraulic pressure is supplied to the chamber $25_2$ the operating plunger $23_2$ receives the hydraulic pressure and pivots the second rotating cam plate $17_2$ to the fourth rotational position D via the pressure-receiving pin $28_2$.

Moreover, a cylindrical spring retaining tube $35_2$ is latched at an end portion on the open side of each of the cylinder holes $21_2$ via a retaining ring $36_2$, and a return spring $27_2$ is provided under compression between the spring retaining tube $35_2$ and the return plunger $24_2$, the return spring $27_2$ urging the return plunger $24_2$ toward the pressure-receiving pin $28_2$.

Figure 11:
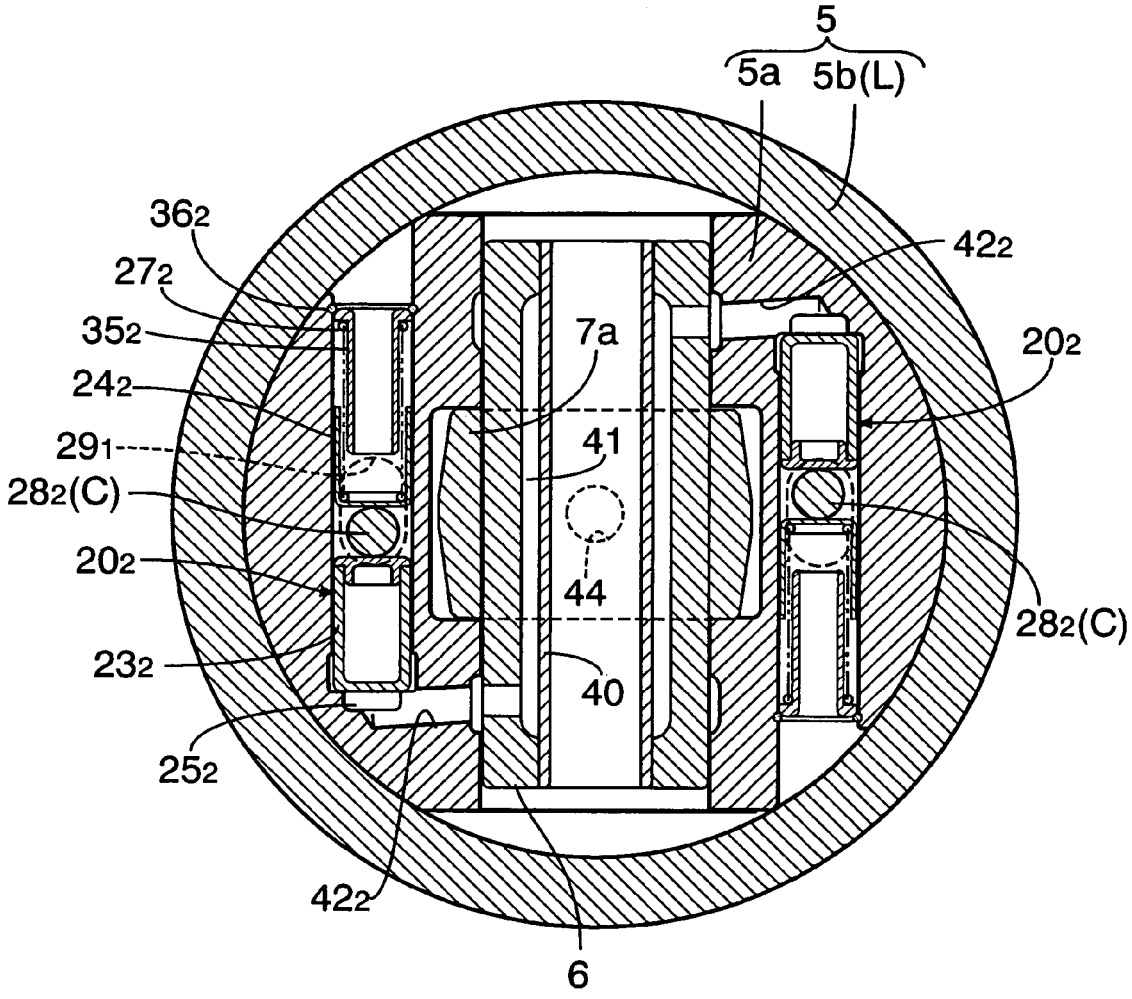
FIG. 11 is an enlarged sectional view along line 11—11 in FIG. 3.
Figure 12:
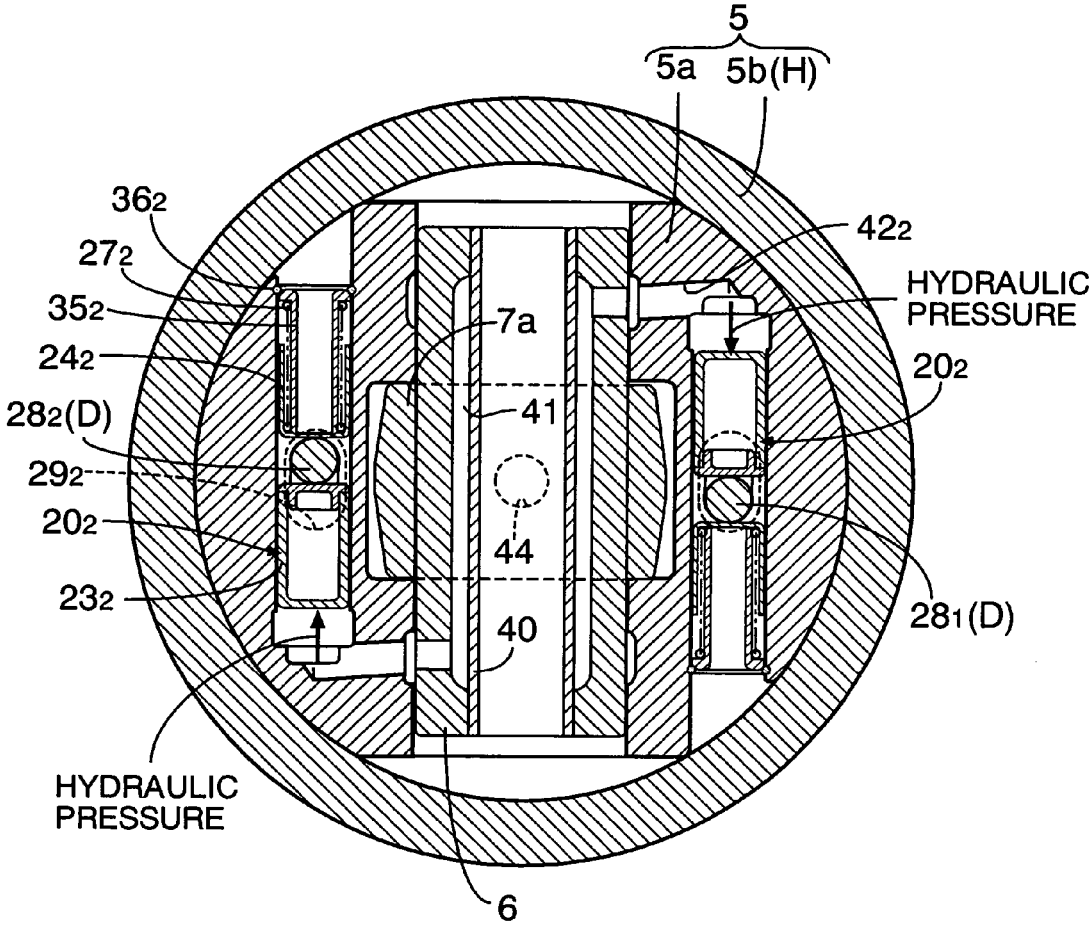
FIG. 12 is an enlarged sectional view along line 12—12 in FIG. 4.

In this way, the third rotational position C of the second rotating cam plate $17_2$ is defined by each of the pressure-receiving pins $28_2$ abutting against the extremity of the operating plunger $23_2$, which abuts against the bottom face of the cylinder hole $21_2$ (see FIG. 11), and the fourth rotational position D of the second rotating cam plate $17_2$ is defined by the return plunger $24_2$, which is pushed by the pressure-receiving pin $28_2$, abutting against the extremity of the spring retaining tube $35_2$ (see FIG. 12).

In the above-mentioned arrangement, the first rotating cam plate $17_1$ and the first actuator $20_1$, and the second rotating cam plate $17_2$ and the second actuator $20_2$ allow the outer piston 5*b* to move between the low compression ratio position L and the high compression ratio position H by virtue of an external force that makes the inner piston and outer 5*a* and 5*b* move toward or away from each other in the axial direction, such as a difference in inertial force between the inner piston 5*a* and the outer piston 5*b*, the frictional resistance between the outer piston 5*b* and the inner face of the cylinder bore 2*a*, or negative or positive pressure acting on the outer piston 5*b* from the combustion chamber 4*a* side. Since opposite side faces of each of the upper and lower cam peaks $16_1a$ and $17_1a$, and $16_2a$ and $17_2a$ are vertical faces, it is possible to reduce the gaps in the peripheral direction between adjacent cam peaks $16_1a$ and $17_1a$, and $16_2a$ and $17_2a$, and it is also possible to set a large total area for the top faces of the cam peaks $16_1a$ and $17_1a$, and $16_2a$ and $17_2a$.

Referring again to FIG. 1 and FIG. 2, a tubular oil chamber 41 is defined between the piston pin 6 and a sleeve 40 press-fitted in a hollow portion of the piston pin 6, and first and second oil distribution passages $42_1$ and $42_2$ providing a connection between the oil chamber 41 and the hydraulic chambers $25_1$ and $25_2$ of the first and second actuators $20_1$ and $20_2$ are provided across the piston pin 6 and the inner piston 5*a*. As shown in FIG. 1, the oil chamber 41 is connected to an oil passage 44 that is provided across the piston pin 6, the connecting rod 7, and the crankshaft 9, and this oil passage 44 is switchably connected, via a solenoid control valve 45, to an oil pump 46, which is a hydraulic source, and to an oil reservoir 47. A drive circuit 50 is connected to the solenoid control valve 45, and operating condition determining means 48 is connected to the drive circuit 50. This operating condition determining means 48 determines, from the rotational speed, the load, etc. of the engine, whether the engine should be in the low compression ratio state or the high compression ratio state. When it is determined that the engine should be in the low compression ratio state, the drive circuit 50 puts the solenoid control valve 45 in a non-energized state, and when it is determined that the engine should be in the high compression ratio state, the drive circuit 50 puts the solenoid control valve 45 in an energized state. The solenoid control valve 45 opens the oil passage 44 to the oil reservoir 47 in the non-energized state, and connects the oil pump 46 to the oil passage 44 in the energized state.

Furthermore, a piston position sensor 49 is connected to the drive circuit 50: when the solenoid control valve 45 is energized in order to switch from the low compression ratio state to the high compression ratio state, its energization is started at the midpoint of the exhaust stroke of the piston 5 based on an output signal from the piston position sensor 49; and when the solenoid control valve 45 is de-energized in order to switch from the high compression ratio state to the low compression ratio state, its de-energization is started at the midpoint of the intake stroke of the piston 5 based on an output signal from the piston position sensor 49.

The operation of the first embodiment is now explained.

Switching from High Compression Ratio Position to Low Compression Ratio Position (See FIG. 13 and FIGS. 14A to 14D)

Figure 14A:
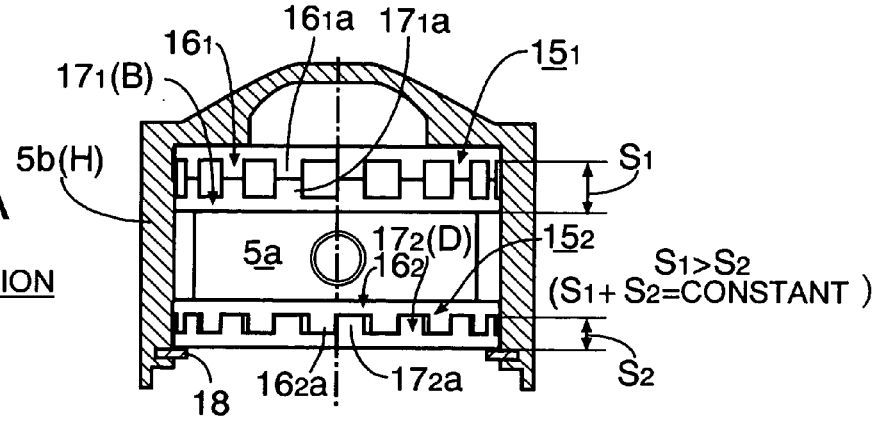
FIGS. 14A to 14D are diagrams for explaining the operation of switching from a high compression ratio state to a low compression ratio state.

Assume that, as shown in FIG. 14A, the outer piston 5*b* is held at the high compression ratio position H. That is, in the first cam mechanism $\mathbf{15}_1$ the upper and lower cam peaks $\mathbf{16}_1a$ and $\mathbf{17}_1a$ are in the axially expanded state in which top faces thereof are facing each other, and in the second cam mechanism $\mathbf{15}_2$ the upper and lower cam peaks $\mathbf{16}_2a$ and $\mathbf{17}_2a$ are in the axially compressed state in which they are meshed with each other.

When, for example, the internal combustion engine E is being rapidly accelerated and is in a state in which knocking easily occurs, the operating condition determining means 48 determines that the engine should be in the low compression ratio state, and the solenoid control valve 45 is put in a non-energized state as shown in FIG. 1, thus opening the oil passage 44 to the oil reservoir 47. With this operation, the hydraulic chambers $\mathbf{25}_1$ and $\mathbf{25}_2$ of the first and second actuators $\mathbf{20}_1$ and $\mathbf{20}_2$ are both opened to the oil reservoir 47 via the oil chamber 41 and the oil passage 44. Therefore, in the first actuator $\mathbf{20}_1$ the return plunger $\mathbf{24}_1$ pushes the pressure-receiving pin $\mathbf{28}_1$ by virtue of the urging force of the return spring $\mathbf{27}_1$ so as to rotate the first rotating cam plate $\mathbf{17}_1$ to the first rotational position A, and in the second actuator $\mathbf{20}_1$ the return plunger $\mathbf{24}_2$ pushes the pressure-receiving pin $\mathbf{28}_2$ by virtue of the urging force of the return spring $\mathbf{27}_2$ so as to rotate the second rotating cam plate $\mathbf{17}_2$ to the third rotational position C.

Since the de-energization of the solenoid control valve 45 is started at the midpoint of intake stroke of the piston 5, in the second half of the intake stroke a downward inertial force acts on the inner piston 5*a* prior to acting on the outer piston 5*b*, and thus the first cam mechanism $\mathbf{15}_1$ is released from the thrust load between the inner piston 5*a* and the outer piston 5*b*. Therefore, the first rotating cam plate $\mathbf{17}_1$ is first quickly rotated to the first rotational position A via the pressure-receiving pin $\mathbf{28}_1$ by virtue of the urging force of the return spring $\mathbf{27}_1$ of the first actuator $\mathbf{20}_1$ (see FIG. 8).

Figure 14B:
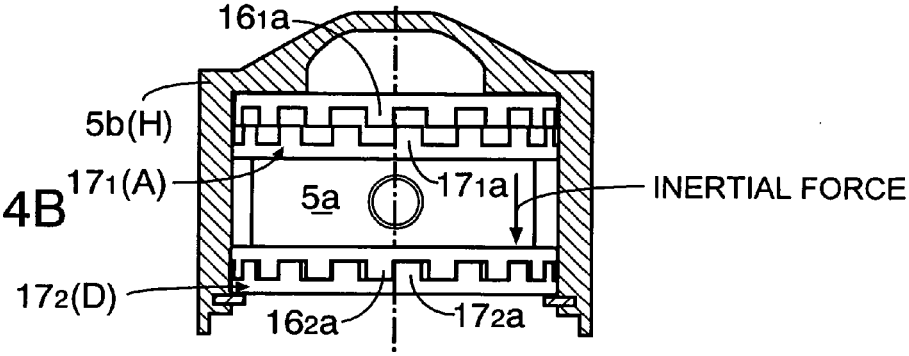

As a result, as shown in FIG. 14B, the upper and lower cam peaks $\mathbf{16}_1a$ and $\mathbf{17}_1a$ of the first cam mechanism $\mathbf{15}_1$ are in a configuration in which they are displaced from each other by half the pitch and can mesh with each other.

Figure 14C:
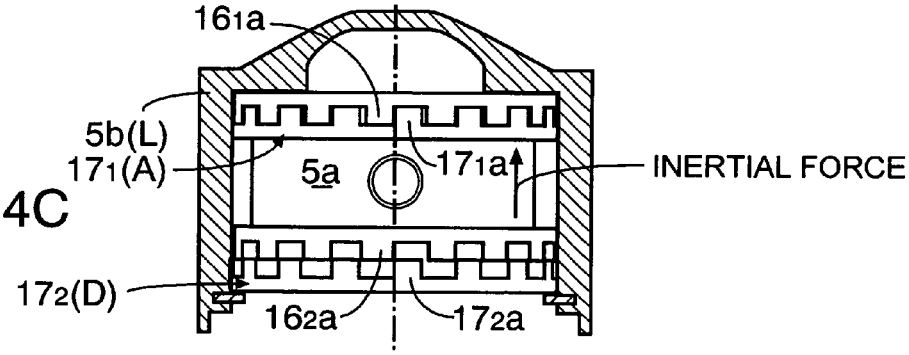

Subsequently, when the piston 5 comes to the second half of the compression stroke, an upward inertial force acts on the inner piston 5*a* prior to acting on the outer piston 5*b*, so that the outer piston 5*b* descends relative to the inner piston 5*a* as shown in FIG. 14C while making the upper and lower cam peaks $\mathbf{16}_1a$ and $\mathbf{17}_1a$ of the first cam mechanism $\mathbf{15}_1$ mesh with each other, that is, while making the first cam mechanism $\mathbf{15}_1$ compress in the axial direction, thus occupying the low compression ratio position L.

In this way, when the outer piston 5*b* descends relative to the inner piston 5*a*, in the second cam mechanism $\mathbf{15}_2$ the second rotating cam plate $\mathbf{17}_2$ descends relative to the second fixed cam $\mathbf{16}_2$, the upper and lower cam peaks $\mathbf{16}_2a$ and $\mathbf{17}_2a$ are accordingly released from the meshed state, and the second rotating cam plate $\mathbf{17}_2$ is therefore quickly rotated to the third rotational position C via the pressure-receiving pin $\mathbf{28}_2$ by virtue of the urging force of the return spring $\mathbf{27}_2$ of the second actuator $\mathbf{20}_2$ (see FIG. 11).

Figure 14D:
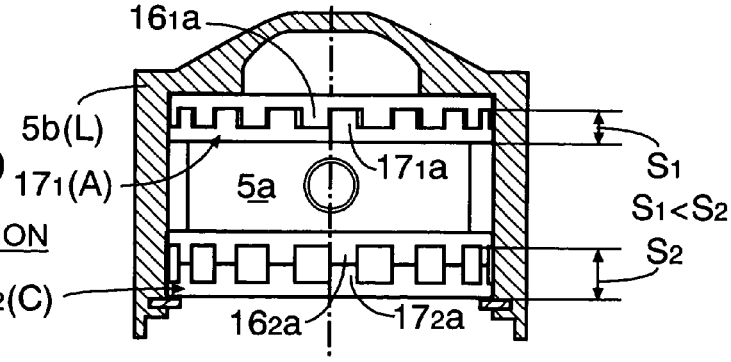

As a result, as shown in FIG. 14D, the flat top faces of the upper and lower cam peaks $\mathbf{16}_2a$ and $\mathbf{17}_2a$ of the second cam mechanism $\mathbf{15}_2$ are made to abut against each other. Due to this kind of axial expansion of the second cam mechanism $\mathbf{15}_2$ the second axial spacing $S_2$ increases, thereby holding the outer piston 5*b* at the low compression ratio position L.

In this way, the inner piston 5*a* and the outer piston 5*b* are securely connected to each other by the first cam mechanism $\mathbf{15}_1$ in the axially compressed state and the second cam mechanism $\mathbf{15}_2$ in the axially expanded state while holding the outer piston 5*b* at the low compression ratio position L, thereby putting the internal combustion engine E in a low compression ratio state.

Switching from Low Compression Ratio Position to High Compression Ratio Position (See FIG. 13 and FIGS. 15A to 15D)

Subsequently, for example when the internal combustion engine E is being operated at high speed, the operating conditions determining means 48 determines that the engine should be in the high compression ratio state, and the solenoid control valve 45 is put in an energized state, thus connecting the oil passage 44 to the oil pump 46. Since hydraulic pressure discharged from the oil pump 46 is supplied to all the hydraulic chambers $\mathbf{25}_1$ and $\mathbf{25}_2$ via the oil passage 44 and the oil chamber 41, in the first actuator $\mathbf{20}_1$ the operating plunger $\mathbf{23}_1$ receives the hydraulic pressure from the first hydraulic chamber $\mathbf{25}_1$ and attempts to rotate the first rotating cam plate $\mathbf{17}_1$ toward the second rotational position B via the pressure-receiving pin $\mathbf{28}_1$, and in the second actuator $\mathbf{20}_2$ the operating plunger $\mathbf{23}_2$ receives the hydraulic pressure from the second hydraulic chamber $\mathbf{25}_2$ and attempts to rotate the second rotating cam plate $\mathbf{17}_2$ toward the fourth rotational position D via the pressure-receiving pin $\mathbf{28}_2$.

Since energization of the solenoid control valve 45 is started at the midpoint of exhaust stroke of the piston 5, in the second half of the exhaust stroke the inner piston 5*a* receives an upward inertial force before the outer piston 5*b* receives it, and the second cam mechanism $\mathbf{15}_2$ disposed between the inner piston 5*a* and the retaining ring 18 is therefore released from the thrust load. The second rotating cam plate $\mathbf{17}_2$ is therefore first quickly rotated to the fourth rotational position D via the pressure-receiving pin $\mathbf{28}_2$ by virtue of the pressing force due to the hydraulic pressure of the operating plunger $\mathbf{23}_2$ of the second actuator $\mathbf{20}_2$ (see FIG. 12).

Figure 15A:
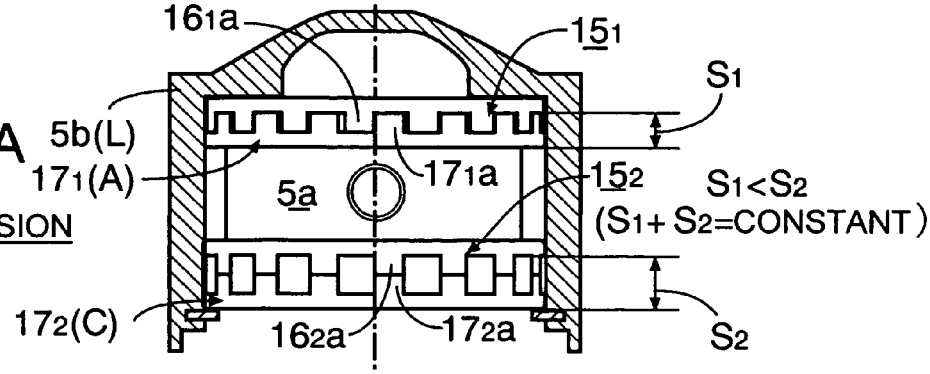
FIGS. 15A to 15D are diagrams of the operation of switching from the low compression ratio state to the high compression ratio state.
Figure 15B:
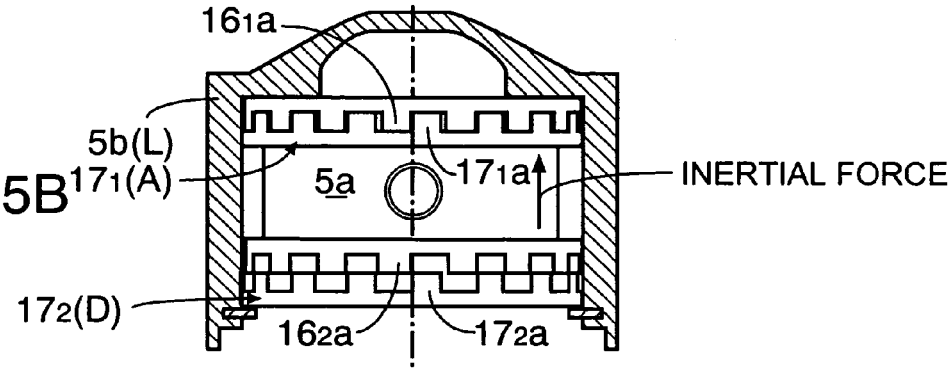

As a result, as shown in FIG. 15B, the upper and lower cam peaks $\mathbf{16}_2a$ and $\mathbf{17}_2a$ of the second cam mechanism $\mathbf{15}_2$ are in a configuration in which they are displaced from each other by half the pitch and can mesh with each other.

Figure 15C:
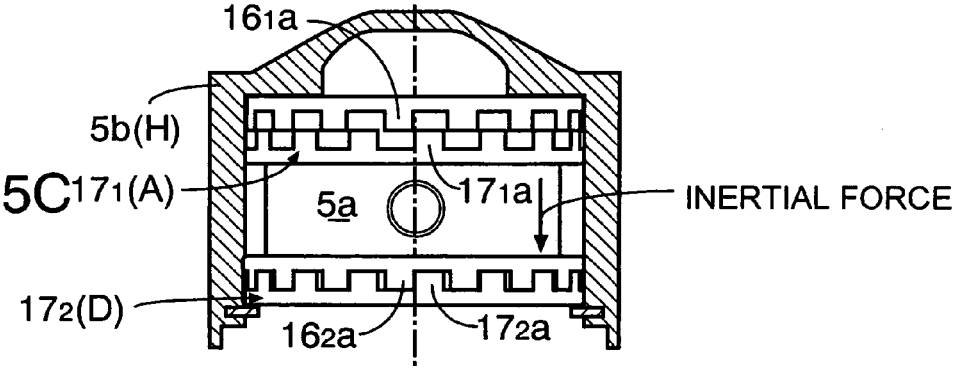
Figure 15D:
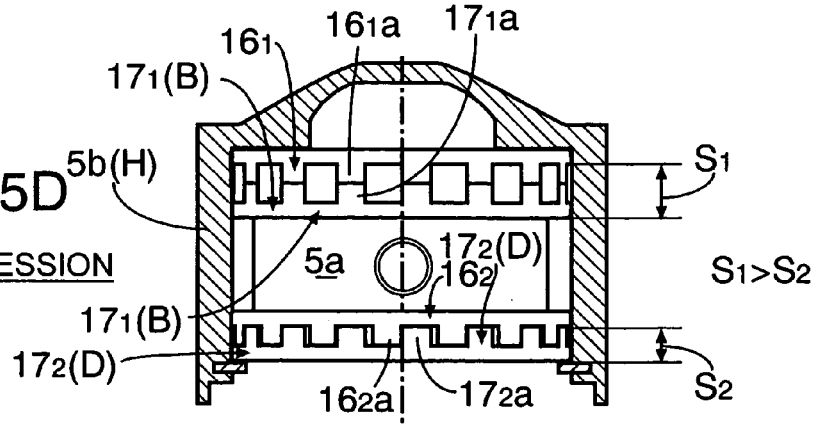

Subsequently, when the piston 5 reaches the second half of the intake stroke, since a downward inertial force acts on the inner piston 5*a* prior to acting on the outer piston 5*b*, the outer piston 5*b* ascends relative to the inner piston 5*a* as shown in FIG. 15C while making the upper and lower cam peaks $\mathbf{16}_2a$ and $\mathbf{17}_2a$ of the second cam mechanism 152 mesh with each other, that is, while making the second cam mechanism 152 compress in the axial direction, thus occupying the high compression ratio position H.

Figure 9:
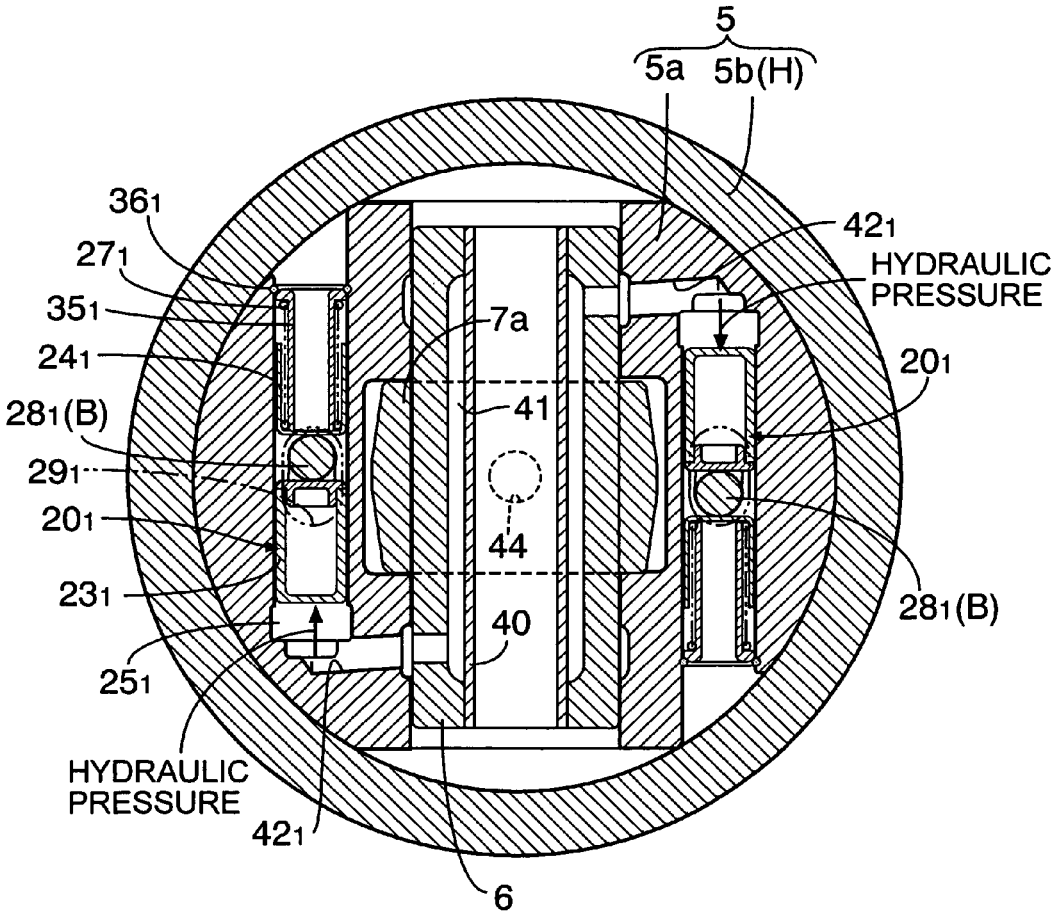
FIG. 9 is an enlarged sectional view along line 9—9 in FIG. 4.
Figure 10:
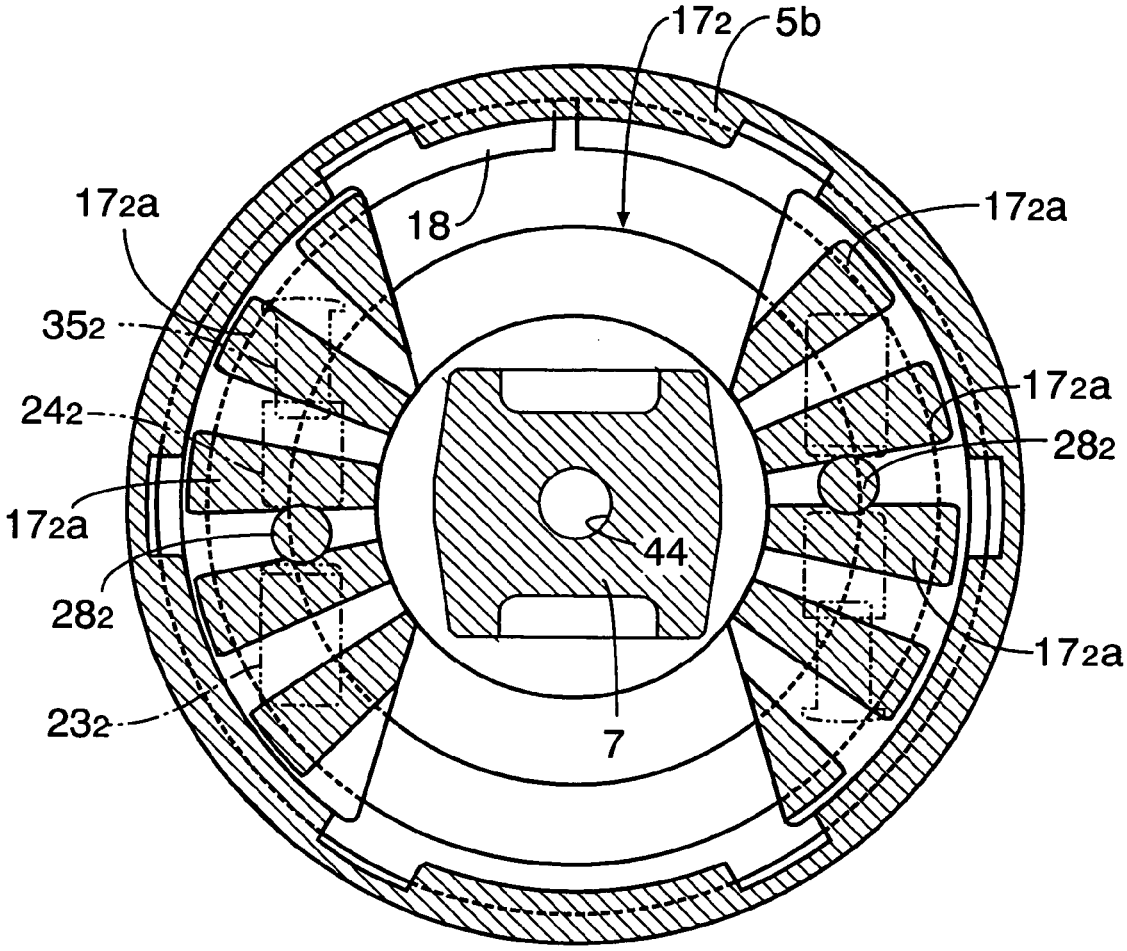
FIG. 10 is an enlarged sectional view along line 10—10 in FIG. 3.

In this way, when the outer piston 5*b* ascends relative to the inner piston 5*a*, in the first cam mechanism $\mathbf{15}_1$ the first fixed cam $\mathbf{16}_1$ ascends relative to the first rotating cam plate $\mathbf{17}_1$, the upper and lower cam peaks $\mathbf{16}_2a$ and $\mathbf{17}_2a$ are accordingly released from the meshed state, and the first rotating cam plate $\mathbf{17}_1$ is therefore quickly rotated to the second rotational position B via the pressure-receiving pin $\mathbf{28}_2$ by virtue of the pushing force, due to hydraulic pressure, of the operating plunger $\mathbf{23}_1$ of the first actuator $\mathbf{20}_1$ (see FIG. 9).

As a result, as shown in FIG. 14D, the flat top faces of the upper and lower cam peaks $\mathbf{16}_1a$ and $\mathbf{17}_1a$ of the first cam mechanism $15_1$ are made to abut against each other. Due to this kind of axial expansion of the first cam mechanism $15_1$, the first axial spacing $S_1$ increases, thereby holding the outer piston 5*b* at the high compression ratio position H.

In this way, the inner piston 5*a* and the outer piston 5*b* are securely connected to each other by the first cam mechanism $15_1$ in the axially expanded state and the second cam mechanism $15_2$ in the axially compressed state while holding the outer piston 5*b* at the high compression ratio position H, thereby putting the internal combustion engine E in a high compression ratio state.

In this case, particularly because the first rotating cam plate $17_1$ is supported on the inner piston 5*a* in an axially immovable manner by the retaining plate 13, and the second rotating cam plate $17_2$ is supported on the outer piston 5*b* in an axially immovable manner by the retaining ring 18 and the shoulder 19, there is no axial play in either cam plate. Therefore, when the first cam mechanism $15_1$ and the second cam mechanism $15_2$ expand and compress alternately by utilizing an external force such as a difference in inertial force between the inner piston and outer 5*a* and 5*b*, it is possible to reliably avoid interference between the first fixed cam $16_1$ and the first rotating cam plate $17_1$, and between the second fixed cam $16_2$ and the first rotating cam plate $17_1$; to allow each of the rotating cam plates $17_1$ and $17_2$ to reliably rotate to the respective desired rotational positions by the driving forces of the first and second actuators $20_1$ and $20_2$; and to reliably hold the outer piston 5*b* at a desired low compression ratio position L and high compression ratio position H.

Furthermore, since the inner piston 5*a* and the outer piston 5*b* are always connected securely to each other in the axial direction via the first and second cam mechanisms $15_1$ and $15_2$ regardless of whether the outer piston 5*b* is at the low compression ratio position L or the high compression ratio position H, the thrust load working between the inner piston 5*a* and the outer piston 5*b* can always be borne mechanically by either the first or second cam mechanism $15_1$ or $15_2$, thus increasing the piston strength effectively and thereby enabling the capacity of the first and second actuators $20_1$ and $20_2$, and consequently the dimensions thereof, to be reduced.

In particular, since an external force such as a difference in inertial force between the inner piston 5*a* and the outer piston 5*b*, the sliding resistance between the outer piston 5*b* and the cylinder bore inner face, and the negative pressure and positive pressure on the combustion chamber 4*a* side can be utilized effectively for moving the outer piston 5*b* to the low compression ratio position L or the high compression ratio position H, and the first and second actuators $20_1$ and $20_2$ for rotating the first and second cam plates $17_1$ and $17_2$ receive a zero or extremely small thrust load from the inner piston 5*a* and the outer piston 5*b*, it is possible to reduce the load of the first and second actuators $20_1$ and $20_2$, and further reduce the capacity and, consequently, the dimensions thereof.

Furthermore, when the outer piston 5*b* moves between the low compression ratio position L and the high compression ratio position H, since its rotation relative to the inner piston 5*a* is restrained by the spline teeth 11*a* and the spline grooves 11*b* that are formed on the mating faces of the inner piston 5*a* and the outer piston 5*b* and that are slidably engaged with each other, it is possible to effectively increase the compression ratio when the outer piston 5*b* is at the high compression ratio position H by making the shape of the head portion 5*bh* of the outer piston 5*b* facing the combustion chamber 4*a* match the shape of the combustion chamber 4*a*, and it therefore becomes possible to employ the five sided roof-shaped combustion chamber 4*a* as illustrated.

Moreover, since the thrust load acting on the first and second actuators $20_1$ and $20_2$ by the inner piston 5*a* and the outer piston 5*b* is zero or extremely small, even if some bubbles are present in oil of the hydraulic chambers $25_1$ and $25_2$ of the first and second actuators $20_1$ and $20_2$, it is possible to hold the outer piston 5*b* stably at the high compression ratio position H or the low compression ratio position L, and no problems are caused.

Furthermore, since the first and second actuators $20_1$ and $20_2$ include the hydraulic chambers $25_1$ and $25_2$, the operating plungers $23_1$ and $23_2$, the return springs $27_1$ and $27_2$, and the return plungers $24_1$ and $24_2$ respectively, it is only necessary to employ one of the hydraulic chambers $25_1$ and $25_2$ for each of the actuators $20_1$ and $20_2$. Moreover, since the operating plungers $23_1$ and $23_2$ and the return plungers $24_1$ and $24_2$ are fitted in the common cylinder holes $21_1$ and $21_2$ provided in the inner piston 5*a*, it is possible to simplify the structure of the first and second actuators $20_1$ and $20_2$.

Furthermore, since a plurality of sets of the first and second actuators $20_1$ and $20_2$ are disposed at equal gaps around the rotational axis of the first and second rotating cam plates $17_1$ and $17_2$ respectively, it is possible to pivot the first and second rotating cam plates $17_1$ and $17_2$ smoothly around their axes without imposing an uneven load. Moreover, since the total output of the plurality of the first and second actuators $20_1$ and $20_2$ is large, it is possible to reduce the capacity of the first and second actuators $20_1$ and $20_2$ and, consequently, the dimensions thereof.

Furthermore, in the first and second actuators $20_1$ and $20_2$, since the operating and return plungers $23_1$ and $24_1$, and $23_2$ and $24_2$ are arranged so that their axes are substantially perpendicular to the radii of the first and second rotating cam plates $17_1$ and $17_2$, the radii crossing the axes of the pressure-receiving pins $28_1$ and $28_2$, it is possible to transfer efficiently the pressing force of the operating and return plungers $23_1$ and $24_1$, and $23_2$ and $24_2$ to the first and second rotating cam plates $17_1$ and $17_2$ via the pressure-receiving pins $28_1$ and $28_2$, thereby contributing to a reduction in the dimensions of the first and second actuators $20_1$ and $20_2$.

Moreover, since the end faces of the operating and return plungers $23_1$ and $24_1$, and $23_2$ and $24_2$ are in line contact with the corresponding cylindrical outer peripheral faces of the pressure-receiving pins $28_1$ and $28_2$, the contact area is comparatively large, thus reducing the plane pressure and contributing to an improvement in the durability.

Furthermore, the first actuator $20_1$ moves the first rotating cam plate $17_1$ to the second rotational position B when operated hydraulically, and the second actuator $20_2$ moves the second rotating cam plate $17_2$ to the fourth rotational position D when operated hydraulically. Therefore, in the event of the hydraulic system malfunctioning, the action of the return springs $27_1$ and $27_2$ of the first and second actuators $20_1$ and $20_2$ enables the outer piston 5*b* to be automatically moved to and held at the low compression position L.

Moreover, since the hydraulic pressure for the hydraulic chambers $25_1$ and $25_2$ of the first and second actuators $20_1$ and $20_2$ is supplied and released by the common control valve 45, it is possible to simplify the hydraulic control system, thereby reducing the cost.

Furthermore, since the hydraulic pressure of the hydraulic chambers $25_1$ and $25_2$ of the first and second actuators $20_1$ and $20_2$ starts to be released during the intake stroke of the engine, and the hydraulic pressure starts to be supplied to the hydraulic chambers $25_1$ and $25_2$ during the exhaust stroke of the internal combustion engine, it is possible to quickly move the outer piston 5*b* from the high compression ratio position H to the low compression ratio position L or from the low compression ratio position L to the high compression ratio position H by effectively utilizing a difference in inertial force between the inner piston 5*a* and the outer piston 5*b*.

Figure 16A:
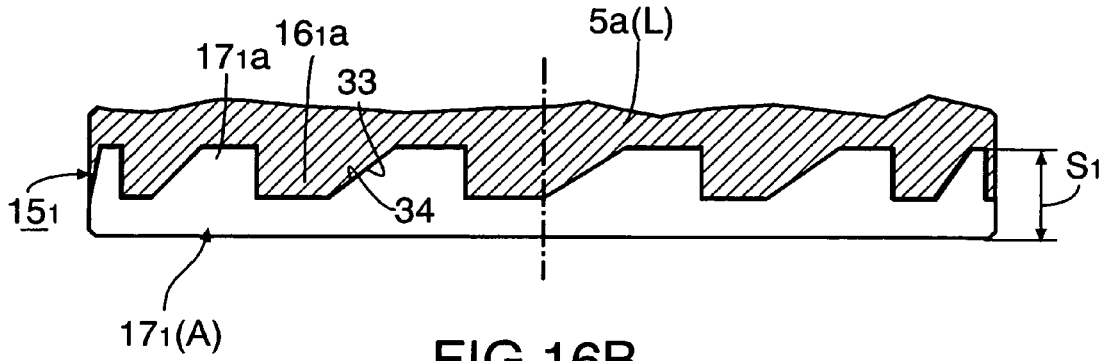
FIGS. 16A to 16C are vertical sectional side views of an essential part of a variable compression ratio system showing a second embodiment of the present invention.
Figure 16B:
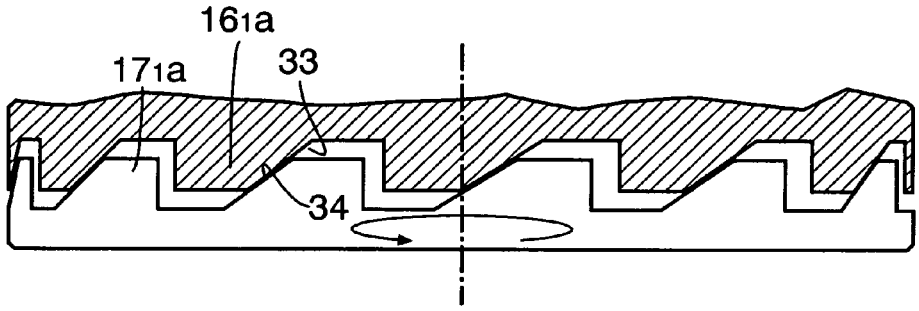
Figure 16C:
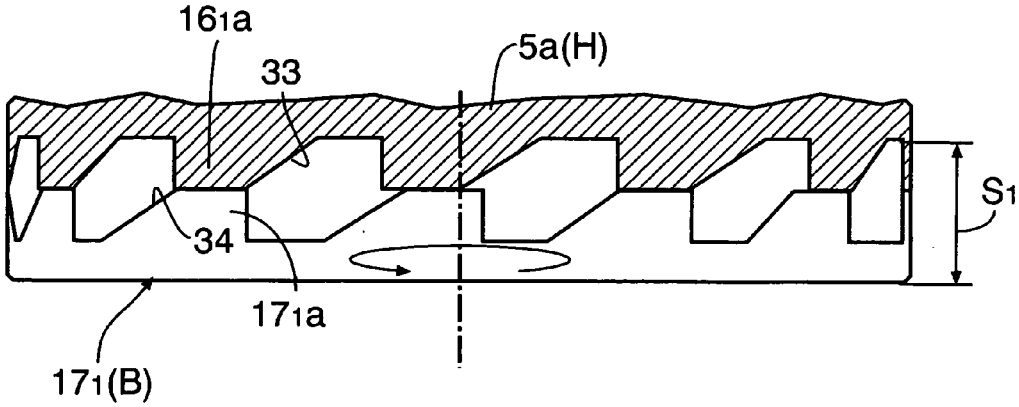

A second embodiment of the present invention shown in FIGS. 16A to 16C is now explained.

This second embodiment has the same arrangement as that of the preceding embodiment except that a cam peak $\mathbf{17}_1a$ of a first rotating cam plate $\mathbf{17}_1$ and a cam peak $\mathbf{16}_1a$ of a first fixed cam $\mathbf{16}_1$ formed in a outer piston 5*b* are provided with inclined faces 33 and 34 so that when the first rotating cam plate $\mathbf{17}_1$ pivots from a first rotational position A to a second rotational position B, the inclined surfaces 33 and 34 slide away from each other in the axial direction. In FIGS. 16A to 16C, parts corresponding to the parts of the first embodiment are denoted by the same reference numerals and symbols, thereby avoiding duplication of the explanation.

In this second embodiment, since one side of each of the cam peaks $\mathbf{16}_1a$ and $\mathbf{17}_1a$ is formed as the inclined surfaces 33 and 34, compared with the preceding embodiment, the gap between adjacent cams $\mathbf{16}_1$ and $\mathbf{17}_1$ increases, the operating stroke angle of the first rotating cam plate $\mathbf{17}_1$ increases, and the area of the top face of each of the cams $\mathbf{16}_1$ and $\mathbf{17}_1$ decreases, but even when the external force for moving the outer piston 5*b* to the high compression ratio position H is weak, applying a force to the first rotating cam plate $\mathbf{17}_1$ to pivot it to the second rotational position B using the first actuator $\mathbf{20}_1$ enables the outer piston 5*b* to be pushed upward to the high compression ratio position H by the mutual lifting action of the inclined surfaces 33, 34. In this case, although it is not illustrated, the same structure can be employed for the second cam mechanism $\mathbf{15}_2$.

Figure 17A:
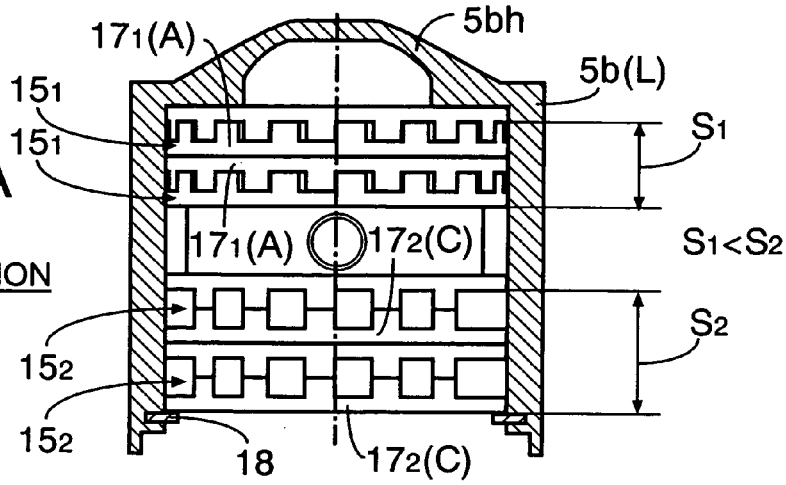
FIGS. 17A to 17C are vertical sectional side views of an essential part of a variable compression ratio system showing a third embodiment of the present invention.
Figure 17B:
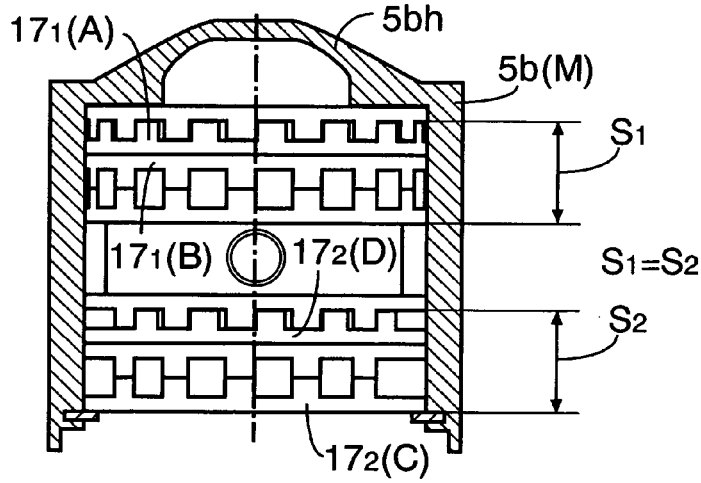
Figure 17C:
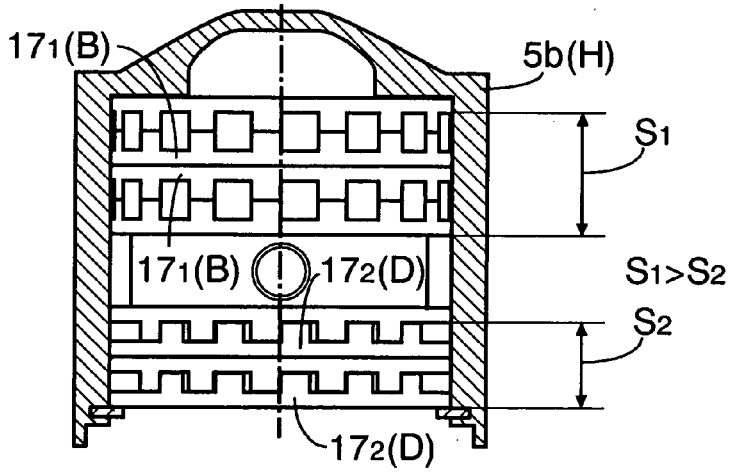

Finally, a third embodiment of the present invention shown in FIGS. 17A to 17C is explained.

This third embodiment is arranged so that in the first embodiment the outer piston 5*b* can be controlled so as to switch between three positions, that is, a low compression ratio position L, a medium compression ratio position M, and a high compression ratio position. A pair of upper and lower first cam mechanisms $\mathbf{15}_1$ are disposed between a inner piston 5*a* and a head portion 5*bh* of the outer piston 5*b*, and a pair of upper and lower second cam mechanisms $\mathbf{15}_2$ are disposed between the inner piston 5*a* and a retaining ring 18 of the outer piston 5*b*, thereby enabling the operating states of the upper and lower first cam mechanisms $\mathbf{15}_1$ to be switched between an in-phase state and an out-of-phase state, and at the same time enabling the operating state of either one of the upper and lower first cam mechanisms $\mathbf{15}_1$ and the operating state of one of the upper and lower second cam mechanisms $\mathbf{15}_2$ to be out of phase with each other, and enabling the operating state of the other one of the upper and lower first cam mechanisms $\mathbf{15}_1$ and the operating state of the other one of the upper and lower second cam mechanisms $\mathbf{15}_2$ to be out of phase with each other. In FIGS. 17A to 17C, parts corresponding to the parts of the first embodiment are denoted by the same reference numerals and symbols.

As shown in FIG. 17A, by operating both the upper and lower first cam mechanisms $\mathbf{15}_1$ in an axially compressed state and both the upper and lower second cam mechanisms $\mathbf{15}_2$ in an axially expanded state, it is possible to control the outer piston 5*b* at the low compression ratio position L; as shown in FIG. 17B, by operating the upper first cam mechanism $\mathbf{15}_1$ in an axially compressed state and the lower first cam mechanism $\mathbf{15}_1$ in an axially expanded state and operating the upper second cam mechanism $\mathbf{15}_2$ in an axially compressed state and the lower second cam mechanism $\mathbf{15}_2$ in an axially expanded state, it is possible to control the outer piston 5*b* at the medium compression ratio position M; and as shown in FIG. 17C, by operating both the upper and lower first cam mechanisms $\mathbf{15}_1$ in an axially expanded state and operating both the upper and lower second cam mechanisms $\mathbf{15}_2$ in an axially compressed state, it is possible to control the outer piston 5*b* at the high compression ratio position H.

The present invention is not limited to the above-mentioned embodiments, and can be modified in a variety of ways without departing from the subject matter of the present invention. For example, the operating mode of the solenoid switch valve 45 can be the opposite of that of the above-mentioned embodiments. That is, an arrangement is possible in which, when the switch valve 45 is in a non-energized state, the oil passage 44 is connected to the oil pump 46, and when it is in an energized state, the oil passage 44 is connected to the oil reservoir 47.

What is claimed is:

1. An internal combustion engine variable compression ratio system comprising:

an inner piston that is connected to a connecting rod via a piston pin;

an outer piston that has a head portion facing a combustion chamber and that is fitted around the outer periphery of the inner piston so that the outer piston can slide only in the axial direction;

restricting means fixedly provided on the outer piston so as to axially oppose the head portion with the inner piston interposed between the restricting means and the head portion;

a first cam mechanism disposed between the inner piston and the head portion for controlling a first axial spacing therebetween; and a second cam mechanism disposed between the inner piston and the restricting means for controlling a second axial spacing therebetween, wherein the first cam mechanism includes a first rotating cam plate that is rotatable between first and second rotational positions around the axis of the inner piston, and is arranged so that the first cam mechanism axially compresses at the first rotational position of the first rotating cam plate so as to allow the first axial spacing to decrease and axially expands at the second rotational position so as to allow the first axial spacing to increase;

wherein the second cam mechanism includes a second rotating cam plate that is rotatable between third and fourth rotational positions around the axis of the inner piston, and is arranged so that the second cam mechanism axially expands at the third rotational position of the second rotating cam plate so as to allow the second axial spacing to increase and axially compresses at the fourth rotational position so as to allow the second axial spacing to decrease; and wherein the first and second rotating cam plates are connected to driving means for moving the first rotating cam plate to the first rotational position and moving the second rotating cam plate to the third rotational position so as to hold the outer piston at a low compression ratio position, and for moving the first rotating cam plate to the second rotational position and moving the second rotating cam plate to the fourth rotational position so as to hold the outer piston at a high compression ratio position.

2. The internal combustion engine variable compression ratio system according to claim 1, wherein the driving means comprises:

a first actuator comprising first hydraulic operating means for moving the first rotating cam plate toward one of the first and second rotational positions and a first return spring urging the first rotating cam plate toward the other of the first and second rotational positions; and a second actuator comprising second hydraulic operating means for moving the second rotating cam plate toward one of the third and fourth rotational positions and a second return spring urging the second rotating cam plate toward the other of the third and fourth rotational positions.

3. The internal combustion engine variable compression ratio system according to claim 2, wherein the first hydraulic operating means is arranged so as to move the first rotating cam plate to the second rotational position when operated hydraulically, and wherein the second hydraulic operating means is arranged so as to move the second rotating cam plate to the fourth rotational position when operated hydraulically.

4. The internal combustion engine variable compression ratio system according to claim 3, wherein supply and release of hydraulic pressure for the first and second hydraulic operating means are carried out by a common control valve.

5. The internal combustion engine variable compression ratio system according to claim 3, wherein release of hydraulic pressure from the first and second hydraulic operating means is started during an intake stroke of the internal combustion engine, and supply of hydraulic pressure to the first and second hydraulic operating means is started during an exhaust stroke of the internal combustion engine.

6. The internal combustion engine variable compression ratio system according to claim 1, wherein there are provided a plurality of the first cam mechanisms and the second cam mechanisms, the numbers thereof being the same.

7. The internal combustion engine variable compression ratio system according to claim 1, wherein the first rotating cam plate is supported by one of the inner piston and the outer piston in an axially immovable but pivotable manner, and a first fixed cam forming the first cam mechanism in cooperation with the first rotating cam plate is fixedly provided on the other one of the inner piston and the outer piston, and wherein the second rotating cam plate is supported by one of the inner piston and the outer piston in an axially immovable but pivotable manner, and a second fixed cam forming the second cam mechanism in cooperation with the second rotating cam plate is fixedly provided on the other one of the inner piston and the outer piston.

8. A method for varying a compression ratio in an internal combustion engine, the engine including:

an inner piston that is connected to a connecting rod via a piston pin;

an outer piston that has a head portion facing a combustion chamber and that is fitted around the outer periphery of the inner piston so that the outer piston can slide only in the axial direction;

restricting means fixedly provided on the outer piston so as to axially oppose the head portion with the inner piston interposed between the restricting means and the head portion;

a first cam mechanism disposed between the inner piston and the head portion for controlling a first axial spacing therebetween; and a second cam mechanism disposed between the inner piston and the restricting means for controlling a second axial spacing therebetween, the method comprising the steps of:

rotating a first rotating cam plate of the first cam mechanism between first and second rotational positions around the axis of the inner piston, thereby axially compressing the first cam mechanism at the first rotational position of the first rotating cam plate allowing the first axial spacing to decrease, and axially expanding the first cam mechanism at the second rotational position allowing the first axial spacing to increase;

rotating a second rotating cam plate of the second cam mechanism between third and fourth rotational positions around the axis of the inner piston, thereby axially expanding the second cam mechanism the third rotational position of the second rotating cam plate allowing the second axial spacing to increase, and axially compressing the second cam mechanism at the fourth rotational position allowing the second axial spacing to decrease, wherein the first and second rotating cam plates are connected to driving means;

moving the first rotating cam plate to the first rotational position, and moving the second rotating cam plate to the third rotational position thereby holding the outer piston at a low compression ratio position; and moving the first rotating cam plate to the second rotational position and moving the second rotating cam plate to the fourth rotational position so as to hold the outer piston at a high compression ratio position.

9. The method for varying a compression ratio in an internal combustion engine according to claim 8, further comprising the steps of:

moving the first rotating cam plate toward one of the first and second rotational positions, and urging the first rotating cam plate toward the other of the first and second rotational positions; and moving the second rotating cam plate toward one of the third and fourth rotational positions, and urging the second rotating cam plate toward the other of the third and fourth rotational positions.

10. The method for varying a compression ratio in an internal combustion engine according to claim 9, further comprising the steps of:

moving the first rotating cam plate to the second rotational position when operated hydraulically, and moving the second rotating cam plate to the fourth rotational position when operated hydraulically.

11. The method for varying a compression ratio in an internal combustion engine according to claim 10, further comprising the steps of:

supplying and releasing a hydraulic pressure for moving the first and the second rotating cam plate with a common control valve.

12. The method for varying a compression ratio in an internal combustion engine according to claim 10, further comprising the steps of:

starting to release hydraulic pressure for moving the first and the second rotating cam plate during an intake stroke of the internal combustion engine, and starting to supply hydraulic pressure for moving the first and the second rotating cam plate during an exhaust stroke of the internal combustion engine.

* * * * *

UNITED STATES PATENT AND TRADEMARK OFFICE

CERTIFICATE OF CORRECTION

PATENT NO. : 6,966,282 B2
APPLICATION NO. : 10/901064
DATED : November 22, 2005
INVENTOR(S) : Makoto Hirano It is certified that error appears in the above-identified patent and that said Letters Patent is hereby corrected as shown below:

On Title Page Item (30)

July 13, 2003 should read -- July 31, 2003 --

Signed and Sealed this

Thirty-first Day of October, 2006

JON W. DUDAS
*Director of the United States Patent and Trademark Office*